US009763841B2

(12) United States Patent
Carlson et al.

(10) Patent No.: US 9,763,841 B2
(45) Date of Patent: Sep. 19, 2017

(54) APPARATUS AND METHOD FOR AUTOMATIC ADJUSTMENT OF A SUPPORT SURFACE WITH INTERWOVEN SUPPORT ELEMENTS

(75) Inventors: J. Martin Carlson, Mora, MN (US); Bryan Flood, Minneapolis, MN (US); Mark Payette, Hugo, MN (US); Mark N. Manzella, Maplewood, MN (US); Wieland Kaphingst, Edina, MN (US)

(73) Assignee: TAMARACK HABILITATION TECHNOLOGIES, INC., Blaine, MN (US)

( * ) Notice: Subject to any disclaimer, the term of this patent is extended or adjusted under 35 U.S.C. 154(b) by 277 days.

(21) Appl. No.: 14/124,181

(22) PCT Filed: Jun. 6, 2012

(86) PCT No.: PCT/US2012/041115

§ 371 (c)(1),
(2), (4) Date: Dec. 5, 2013

(87) PCT Pub. No.: WO2012/170543

PCT Pub. Date: Dec. 13, 2012

(65) Prior Publication Data

US 2014/0103687 A1 Apr. 17, 2014

Related U.S. Application Data

(60) Provisional application No. 61/570,929, filed on Dec. 15, 2011, provisional application No. 61/551,006,
(Continued)

(51) Int. Cl.
*A61G 5/10* (2006.01)
*A61G 7/057* (2006.01)
(Continued)

(52) U.S. Cl.
CPC ..... *A61G 7/057* (2013.01); *A47C 7/32* (2013.01); *A47C 23/28* (2013.01); *A61G 5/1043* (2013.01);
(Continued)

(58) Field of Classification Search
CPC .... A61G 7/057; A61G 5/1091; A61G 5/1043; A61G 5/12; A61G 2203/32;
(Continued)

(56) References Cited

U.S. PATENT DOCUMENTS 4,685,738 A * 8/1987 Tinus ..... A47C 7/02 160/DIG. 15
4,858,992 A * 8/1989 LaSota ..... B60N 2/002 297/284.2
(Continued)

FOREIGN PATENT DOCUMENTS

CA 2497143 A1 8/2005
DE 19927096 A1 3/2000
(Continued)

OTHER PUBLICATIONS

European Extended Search Report for 12796105.0, dated Nov. 5, 2014.
(Continued)

*Primary Examiner* — Philip Gabler
(74) *Attorney, Agent, or Firm* — Westman, Champlin & Koehler, P.A.; Z. Peter Sawicki; Amanda M. Prose

(57) ABSTRACT

An apparatus is disclosed for adjusting an active length of a plurality of interwoven support elements of a weight bearing surface to conform to contours of a user's anatomy. The weight bearing surface overlies a frame to which the plurality of interwoven support elements are connected. The apparatus includes an adjustment mechanism connected to one of the plurality of interwoven support elements, wherein
(Continued)

the adjustment mechanism is attached or releasably attached to the frame. The adjustment mechanism allows the active length of the connected interwoven support element to change as a user bears upon the weight bearing surface, thereby conforming the weight bearing surface to the contours of a user's anatomy. In another aspect, a method for adjusting an active length of at least some of a plurality of interwoven support elements of a weight bearing surface to conform to contours of a user's anatomy is disclosed.

22 Claims, 22 Drawing Sheets

Related U.S. Application Data filed on Oct. 25, 2011, provisional application No. 61/494,190, filed on Jun. 7, 2011.

(51) Int. Cl.
*A47C 23/28* (2006.01)
*A47C 7/32* (2006.01)
*A61G 5/12* (2006.01)

(52) U.S. Cl.
CPC ..... *A61G 5/1091* (2016.11); *A61G 5/12* (2013.01); *A61G 2203/32* (2013.01); *A61G 2203/34* (2013.01); *A61G 2203/40* (2013.01); *A61G 2203/42* (2013.01); *A61G 2203/44* (2013.01)

(58) Field of Classification Search
CPC ..... A61G 2203/34; A61G 2203/40; A61G 2203/42; A61G 2203/44; A47C 7/32; A47C 23/28
USPC ..... 297/217.3, 217.4, 284.2
See application file for complete search history.

(56) References Cited

U.S. PATENT DOCUMENTS

| | | | | |
|---|---|---|---|---|
| 5,058,952 | A * | 10/1991 | LaSota | A47C 23/24 297/284.2 |
| 6,068,339 | A * | 5/2000 | Linzalone | B60N 2/448 297/463.1 |
| 6,536,791 | B1 * | 3/2003 | Adams | A47C 7/22 280/250.1 |
| 2005/0172398 | A1 * | 8/2005 | Smith | A61G 5/1043 5/81.1 R |
| 2006/0186723 | A1 * | 8/2006 | Kawabata | A47C 7/22 297/452.1 |
| 2009/0273213 | A1 * | 11/2009 | Mukherjee | A47C 31/126 297/217.3 |
| 2011/0006582 | A1 * | 1/2011 | Carlson | A61G 5/1043 297/452.48 |
| 2011/0107516 | A1 | 5/2011 | Jackson et al. | |
| 2012/0019030 | A1 * | 1/2012 | Menard | A47C 1/12 297/217.3 |

FOREIGN PATENT DOCUMENTS

| | | | |
|---|---|---|---|
| EP | 1076322 | A2 | 2/2001 |
| EP | 2258330 | A1 | 12/2010 |
| GB | 2181047 | A | 4/1987 |
| JP | 53092995 | U | 12/1951 |
| JP | S62-109568 | A | 5/1987 |
| JP | H03-178608 | A | 8/1991 |
| JP | 2009254782 | A | 11/2009 |
| KR | 2003043508 | A | 6/2003 |
| RU | 45133 | U1 | 4/2005 |

OTHER PUBLICATIONS

PCT Search Report and Written Opinion; PCT/US2012/041115; Sep. 20, 2012.
Office Action issued in corresponding Japanese Patent Application No. 2014-514595 dated Mar. 22, 2016.
Patent Examination Report issued for related Australian patent application No. 2012268033, issued Nov. 10, 2015.
Office Action issued in corresponding Japanese Patent Application No. 2014-514595 dated Jan. 17, 2017.

* cited by examiner 181
184
180
174
145
166
174
145
174
165
174
145
174
145
174
174
174

APPARATUS AND METHOD FOR AUTOMATIC ADJUSTMENT OF A SUPPORT SURFACE WITH INTERWOVEN SUPPORT ELEMENTS

CROSS REFERENCE TO RELATED APPLICATIONS

This application is a Section 371 National Stage Application of International Application No. PCT/US2012/041115, filed Jun. 6, 2012 and published as WO2012/170543 on Dec. 13, 2012, which claims the benefit of priority from U.S. Provisional Patent Application No. 61/494,190, filed Jun. 7, 2011; U.S. Provisional Patent Application No. 61/551,006, filed Oct. 25, 2011; and U.S. Provisional Patent Application No. 61/570,929, filed Dec. 15, 2011, which are hereby incorporated by reference in their entirety.

BACKGROUND

Support surfaces have a critical role in modern society. This is especially true of support surfaces for wheelchairs and beds. The support surface in a wheel chair is commonly called a seat or "seat cushion." The support surface on a bed is commonly called a bed or mattress.

For those users who must spend large amounts of time in a wheelchair or bed, the support surface should achieve a number of objectives. First, the support surface should maximize user function. This includes maximizing the user's ability to maneuver and to engage in activities. Second, the support surface should be comfortable for the user. Third, the support surface should be reliable and durable. Fourth, the support surface should be easy to clean and maintain. Moreover, the support surface should be safe for the user. Many aspects of support surface design can simultaneously affect user comfort, function, and safety. For example, if a user is not stable upon the support surface, the user likely will not be comfortable, will not have adequate function, and will not be safe.

When a user has paralysis, decreased sensation or absent sensation, a particular danger can be the formation of decubitus ulcers (commonly known as "pressure ulcers" or "bed sores"). Decubitus ulcers are lesions that form on parts of the body that are in ongoing contact with objects such as a mattress, seat cushion or other support surface. The symptoms of decubitus ulcers range from skin redness (stage I) to "tunneling ulcers" with necrosis of the skin, fat, muscle and even bone (stage IV).

Decubitus ulcers are of major concern to the afflicted patients, their caregivers, and the medical community. The scale of the problem is immense. It is estimated that approximately 1.2 million people are suffering from decubitus ulcers at any one time in the United States alone. It is reported that there are 60,000 deaths annually from complications arising from decubitus ulcers and the current cost to the U.S. Health Care System to treat these and other associated conditions is estimated at US$15-$40 billion annually.

Wheelchair and bed users can face a truly daunting challenge in trying to prevent and manage decubitus ulcers. Decubitus ulcers can lead to hospitalization, plastic surgery, and even amputation. Once a patient has had an ulcer with skin scarring, the risk of future ulcers increases. Those afflicted can face a repeating cycle of ulcer formation, hospitalization and surgery.

The repeated insult to the body, however, is only part of the affliction. Hospitalization and long-term rest can destroy families and social networks and severely hamper work and leisure. Costs incurred because of decubitus ulcers can be dramatic as well. In some cases, a single patient can incur ulcer-related medical costs that go well beyond one million dollars. Indirect costs such as lost productivity increase this monetary burden.

The general reason wheelchair bound and bed ridden patients face problems with decubitus ulcers is clear. Prolonged lying upon a mattress or sitting upon a seat cushion, especially with no ability or limited ability to move, creates prolonged pressure and shear/friction loads on the body, thereby leading to ulceration. A mobile person turns frequently while sleeping or shifts while sitting; this relieves shear & pressure loads and provides for healthy blood circulation. In an immobile patient, pressure loads can much more easily occlude blood flow and lead to tissue damage. As shown in FIG. 5, some regions of the body that are often affected in bed ridden patients are tissues near bony areas such as cranium 390, scapula 391, sacrum 392, ischial tuberosities (149*a*, 149*b* in FIGS. 2 and 3), elbow and heel bone (calcaneus) 394. As shown in FIG. 2, wheelchair users are generally affected in tissue near bony areas such as the sacral region 143; coccyx; ischial tuberosities 149*a*, 149*b*; and greater trochanters 147*b*. These regions are commonly referred to as "bony prominences."

The traditional way to avoid formation of decubitus ulcers in bed users is for a family member, caregiver or institutional employee to regularly turn (it is recommended that this be done every two hours) and stabilize a patient in a new position to relieve pressure loads and re-establish blood flow. This has to be done around the clock and has a considerable number of drawbacks.

Some prior art wheelchair cushions and bed mattresses attempt to prevent ulceration by equalizing pressure loads over a body. Wheelchair cushions made from thick sections of foam attempt to equalize pressure loads using a very compressible surface. Water beds attempt to equalize pressure loads using a fluid medium. However, even these devices still lead to ulceration in critical areas.

Some prior art beds attempt to mimic the natural turning of a mobile person by automatically tilting and/or rotating the support surface. Other prior art beds inflate and deflate internal air bladders to vary the location of pressure loads over time. These beds attempt to prevent ulceration by constantly changing which tissues are subject to the greatest pressure loads.

Another method for avoiding formation of ulcers is to carefully fit a support surface to the user. This careful fitting distributes pressure loads in a way that minimizes pressure in critical areas and raises pressure loads in more tolerant areas. Ideally, no areas are subject to pressure loads that would lead to occlusion of blood flow. However, an expensive custom support surface is usually required. Prior art support surfaces have been made, for example, by custom shaping large blocks of foam into mattresses or seat cushions.

The prior art practice of shaping large blocks of foam is an iterative, expensive, and time consuming process that requires a skilled fitter. The typical prior art process uses a plaster cast of a patient's body to mold the foam. Modifications are made to the plaster cast so that pressure relief will be incorporated into certain areas of a custom fit support surface. However, these modifications cannot be checked until after molding.

Changes in patient's body shape or mass, such as is common in disabled populations due to atrophy or weight loss, can alter the required support surface shape. When a new support surface shape is required, the above process must be repeated. Moreover, even newly made prior art custom fit support surfaces sometimes fit poorly and require additional modification.

Fitting a custom support surface is an extremely difficult process that has many variables and is very individualized. For example, a fitter must consider the user's gender, size, weight, disability, deformities, personal preferences, and subjective comfort. To minimize the risk of decubitus ulcers, it is imperative that the user's support surface fits properly. However, even professional fitters often lack the finances, options, time and knowledge to provide an ideally fit support surface. Moreover, because health insurance reimbursement is poor for custom fitting mattresses, seat cushions and other support surfaces, there is a resulting reluctance by professionals to perform this type of work. As a result, poorly fit support surfaces often lead to an increased risk of ulceration.

One prior art technique requires making an impression, making a plaster cast from the impression, and modifying the cast after curing by adding or removing plaster. The fitter uses the modifications to customize the seating pressure or fit of the support surface in various ways. A support surface is typically molded from the modified plaster cast, thus the final support surface reflects the modifications to the plaster cast. However, modifications to plaster casts are not always ideal. After test fitting a custom-fit support surface, sometimes additional modifications are needed to meet the needs of the user for a good fit, comfort and safety; in that case, another custom molded support surface must be made and again test-fitted. This process of trial and error is time consuming and expensive.

Test fitting often involves the use of a pressure mat to determine if a support surface is performing adequately. Pressure mats commonly used in the wheelchair seating industries often read pressure values in millimeters of mercury. Determining acceptable pressure values for a sitting support surface is a subjective endeavor that depends upon the needs of each patient. As a general guideline, it is common that a pressure of 100 millimeters of mercury, especially in a critical area, could be considered excessive while a pressure of 40 to 60 millimeters of mercury is more likely to be an acceptable value.

Another prior art method of creating a custom fit support surface uses CAD (computer aided drafting)/CAM (computer aided manufacturing) techniques. Shape data is collected by scanning a previously taken plaster cast impression or by directly scanning a person's body. This shape data is modified electronically using a CAD system such that the final custom support surface will incorporate pressure relief in critical areas. A custom fit support surface can be manufactured semi-automatically by a robotic machining center. Typically this robotic machining center is a computer numeric control mill. This prior art method suffers many of the problems of previous methods. Modifications to the custom fit support surface are still being made on a trial and error basis. Only after the custom fit support surface is manufactured can it be test fit to the patient. If the electronic modifications prove to be less than ideal and further modifications to the custom fit support surface are needed, another custom fit support surface must be manufactured and the original discarded.

Most prior art support surfaces utilize a mattress or other type of cushion to support the user. However, mattresses and cushions are typically good insulators, lack breathability, and do not distribute pressure ideally. Moreover, bed sheets, seat cushion covers and clothing materials commonly used with such supports are usually not designed or selected to minimize frictional forces. When "local factors" such as pressure, shear, heat, and moisture rise, the rate of tissue damage leading to ulcer formation increases. Ideally pressure, shear stresses, excess temperature increases and moisture should be minimized.

SUMMARY

In one aspect, an apparatus is disclosed for adjusting an active length of a plurality of interwoven support elements of a weight bearing surface to conform to contours of a user's anatomy. The weight bearing surface overlies a frame to which the plurality of interwoven support elements are connected. The apparatus comprises an adjustment mechanism connected to one of the plurality of interwoven support elements, wherein the adjustment mechanism is attached or releasably attached to the frame. The adjustment mechanism allows the active length of the connected interwoven support element to change as a user bears upon the weight bearing surface, thereby conforming the weight bearing surface to the contours of a user's anatomy.

In another aspect, a method for adjusting an active length of at least some of a plurality of interwoven support elements of a weight bearing surface to conform to contours of a user's anatomy is disclosed. The method comprises providing an adjustment mechanism connected to one of the plurality of interwoven support elements; positioning a user upon said weight bearing surface; and allowing the adjustment mechanism to change the active length of the connected interwoven support element in response to weight of the user bearing upon the weight bearing surface.

BRIEF DESCRIPTION OF THE DRAWINGS

The disclosed subject matter will be further explained with reference to the attached figures, wherein like structure or system elements are referred to by like reference numerals throughout the several views.

DETAILED DESCRIPTION

Figure 1:
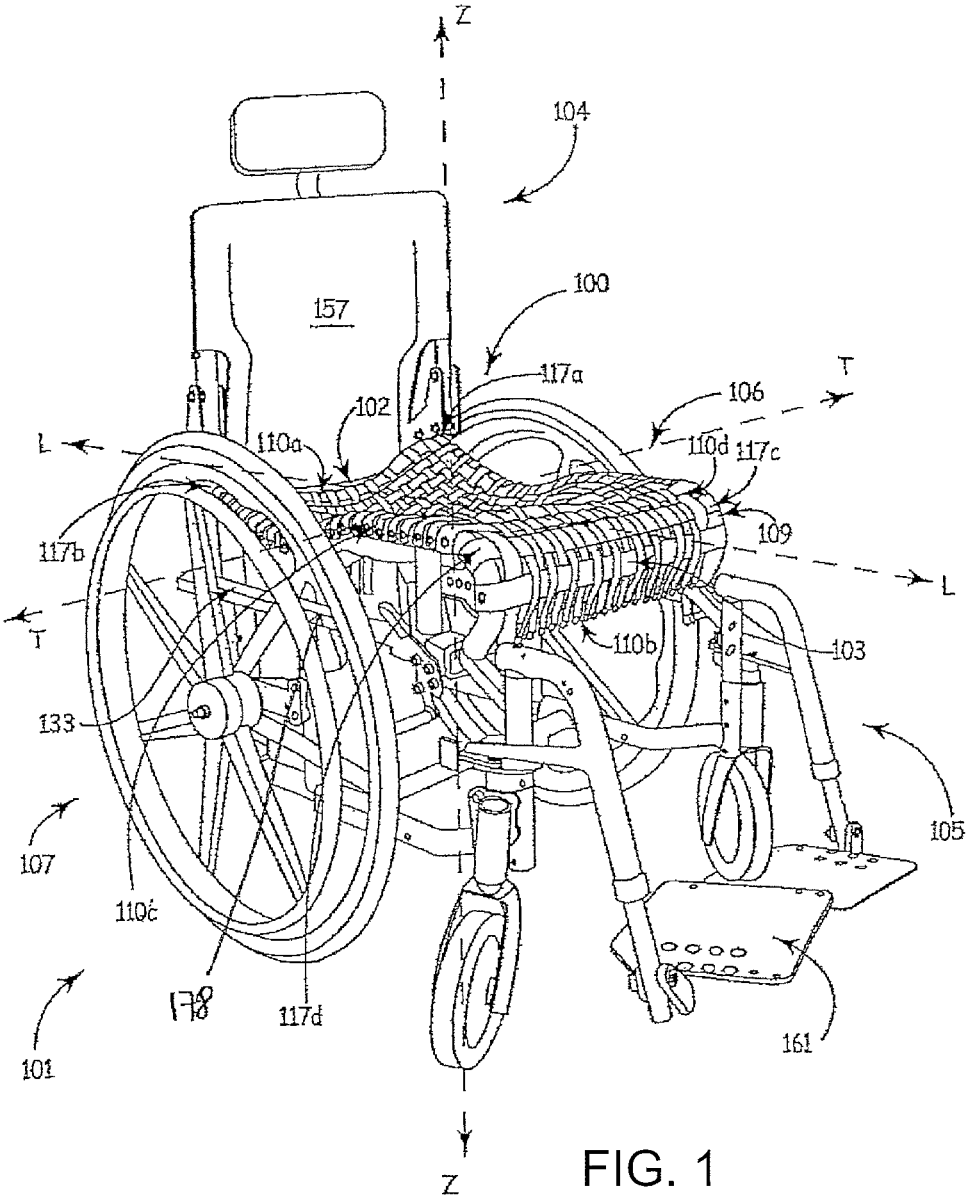
FIG. 1 is a perspective view of a wheelchair having a seat cushion with interwoven support elements, adjusted by using the disclosed adjustment apparatus and method.

The present disclosure describes an adjustment mechanism and method for use with a bed or wheelchair for substantially automatically adjusting a support surface with interwoven support elements for a particular user quickly, accurately, and without the requirement of a high level of skill on the part of the fitter. This offers numerous advantages over prior art custom fabrication and fitting techniques.

In contrast to taking an impression cast or using a CAD/CAM system, the disclosed adjustment mechanism can be used to adjust a user's actual seat cushion or bed. This has several advantages. Adjustments can be made more quickly, easily and inexpensively than modifications to prior art support surfaces. Adjustments are often made with a user positioned upon the support surface, allowing immediate feedback for fit and further adjustments. Adjustments can be performed without discarding the support surface or modifying plaster casts. Furthermore, adjustments in an exemplary method are substantially automatic, thus requiring little fitter expertise. The fitting may take into consideration physical and environmental factors that affect the fit. In a wheelchair, some physical and environmental factors might include the user's posture when driving the wheels, the roughness of the floor, torso control requirements and the preferred position of person's head, for example. The disclosed adjustment mechanism can allow for measurements of the support surface with interwoven support elements to be taken at any time during the fitting process.

The disclosed adjustment mechanisms allow a support surface to be custom shaped to the particular contours of many different users with unique anatomy. For example, the support surface can effectively be used to create depressions, firm surfaces, and so forth. This can be critical in creating a weight-bearing surface that can conform to the shape of a body and can offload pressure from tissue at and near boney prominences. Some areas of a body, such as some parts of the torso or posterior thighs, can withstand greater pressure loads than other more sensitive areas. Offloading means reducing or redistributing loads on a body, typically to reduce pressure loads in critical areas.

Properly adjusted, a support surface with interwoven support elements provides a very stable weight-bearing surface. Many other support surfaces such as those that have fluid or air-filled compartments lose pressure due to leakage or changes in atmospheric pressure. The disclosed support surface, on the other hand, can offer a very stable and ideally contoured weight-bearing surface over the long term.

In one aspect, a method is disclosed for adjusting interwoven support elements of a support surface to conform the surface to contours of a human user's anatomy. The support surface has a plurality interwoven support elements connected to a plurality of adjustment mechanisms. Each of the adjustment mechanisms allows the respective interwoven support elements connected thereto to adjust as the user sits or lays upon the support surface, thereby conforming to contours of the user's anatomy. Moreover, each of the adjustment mechanisms may retain each of the interwoven support elements in its adjusted configuration.

FIG. 1 shows a wheelchair 101 with an especially suitable seat cushion 100 on which the disclosed adjustment mechanisms and methods are used. The wheelchair 101 has a rear 102, a front 103, a top 104, a bottom 105, a left side 106 and a right side 107 (from the viewpoint of a wheelchair user 108, shown in FIG. 2, sitting in the wheelchair 101).

The wheelchair 101 and the seat cushion 100 shown in FIG. 1 are oriented with respect to a longitudinal line L. The term "longitudinal" refers to a line, axis, or direction in the plane that is substantially aligned with the line L. The length of the wheelchair 101 or seat cushion 100 is its maximum dimension measured parallel to line L.

The wheelchair 101 shown in FIG. 1 can further be oriented with respect to a transverse line T that is perpendicular to the longitudinal line L. The term "transverse" refers to a line, axis, or direction in the plane of the wheelchair 101 or seat cushion 100 that is substantially aligned with the line T. The width of the wheelchair 101 or seat cushion 100 is the maximum dimension measured parallel to line T.

The wheelchair 101 or seat cushion 100 can further be oriented with respect to a line Z, which is perpendicular to the plane formed by lines L and T and generally corresponds to the direction associated with the height dimension of the wheelchair 101 or seat cushion 100. The height of the wheelchair 101 or seat cushion 100 is the maximum dimension measured parallel to the vertical line Z.

Figure 3:
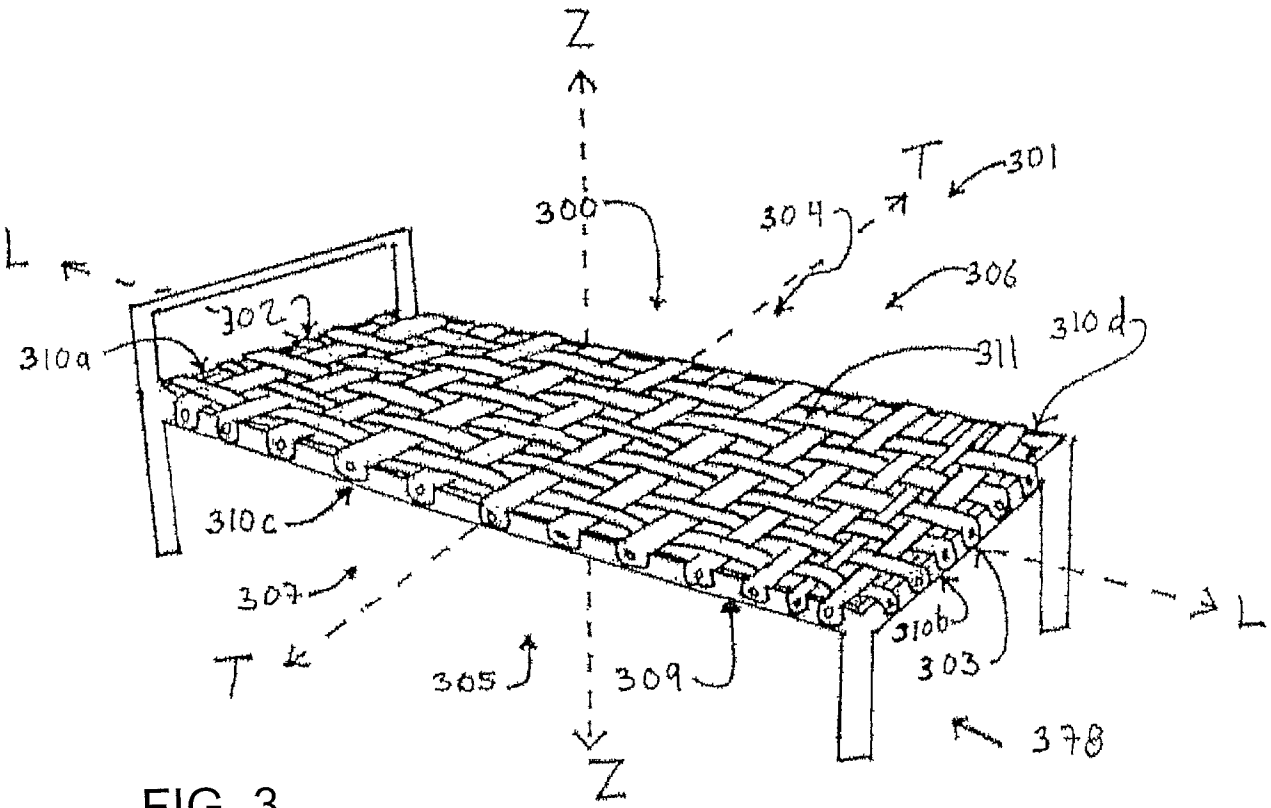
FIG. 3 is a perspective view of a bed having a mattress with interwoven support elements, on which the disclosed adjustment apparatus and method can be used.
Figure 4:
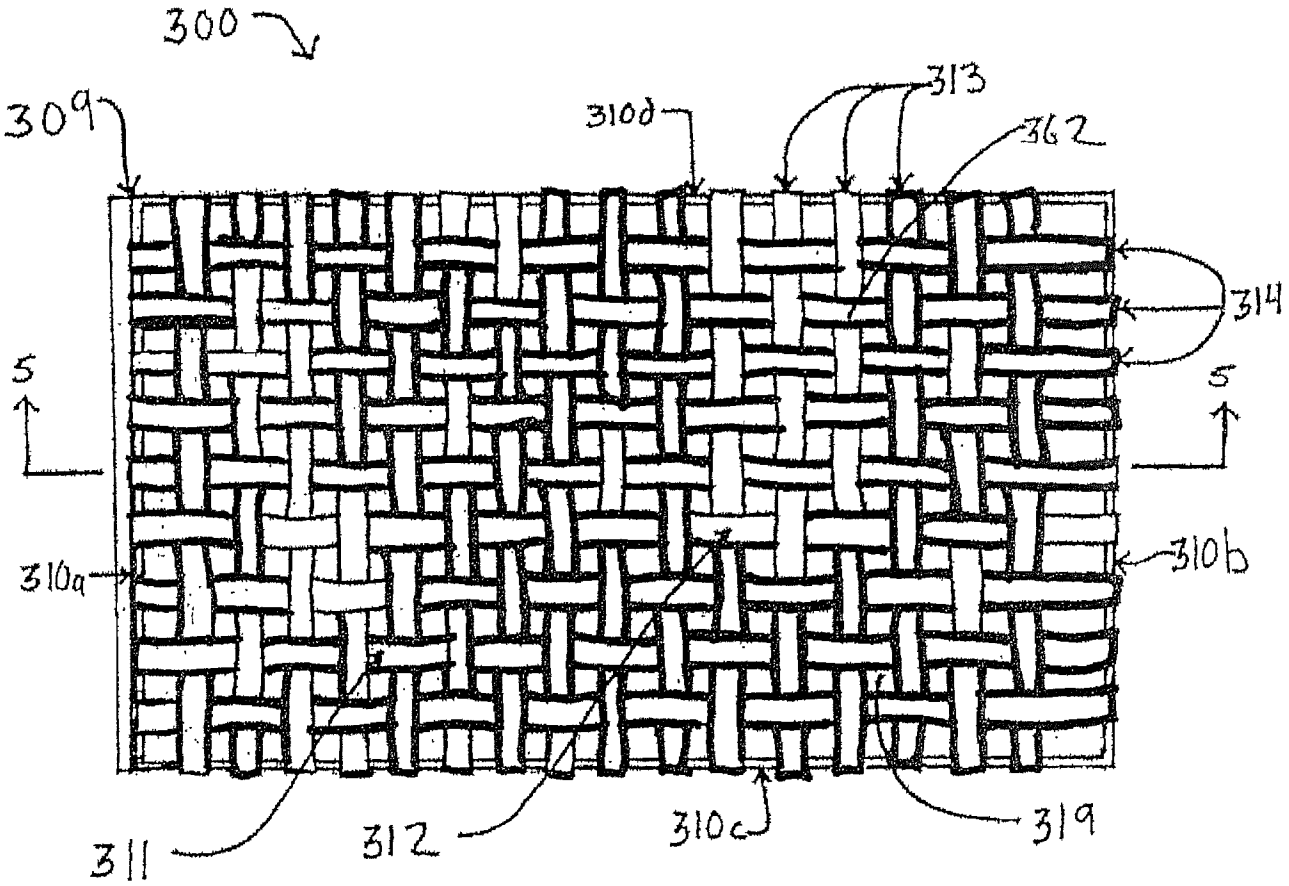
FIG. 4 is a plan view of a bed having a mattress with interwoven support elements, on which the disclosed adjustment apparatus and method can be used.
Figure 5:
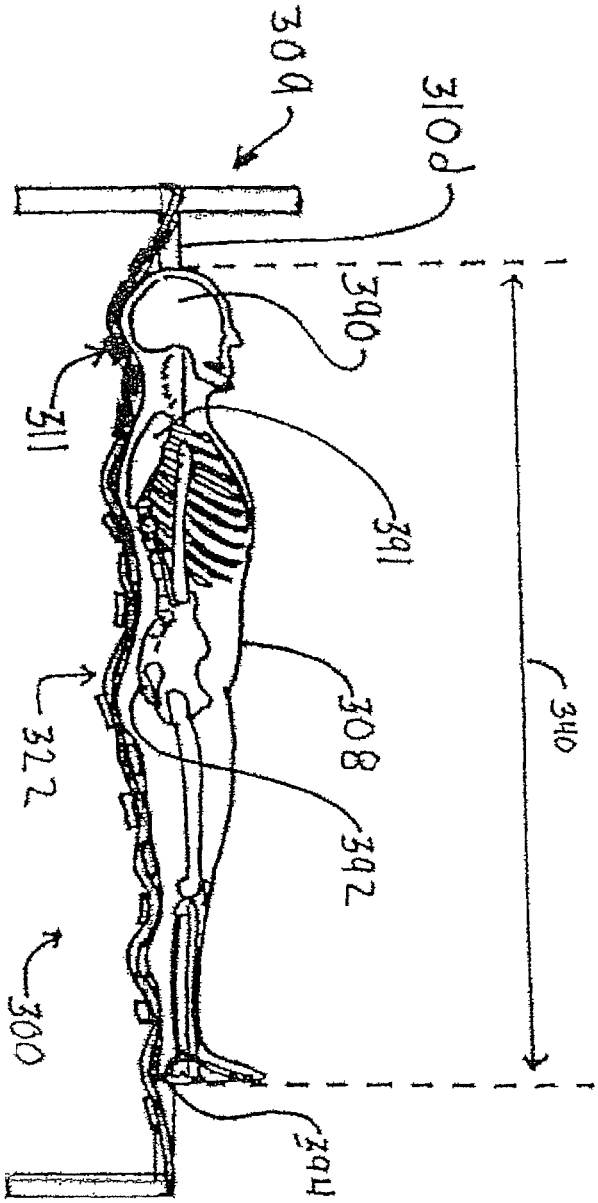
FIG. 5 is a section view along line 5-5 from FIG. 4 of a bed having a mattress with interwoven support elements and a user 308.

FIGS. 3-5 show a bed 301 with an especially suitable mattress 300 on which the disclosed adjustment mechanisms and methods can be used. Bed 301 has a rear 302, a front 303, a top 304, a bottom 305, a left side 306 and a right side 307 (from the viewpoint of a bed user 308 shown in FIG. 5.)

Bed 301 and mattress 300 are oriented with respect to a longitudinal line L. The term "longitudinal" refers to a line, axis, or direction in the plane that is substantially aligned with line L. The length of bed 301 or mattress 300 is its maximum dimension measured parallel to line L.

Bed 301 shown in FIG. 3 can further be oriented with respect to a transverse line T that is perpendicular to longitudinal line L. The term "transverse" refers to a line, axis, or direction in the plane of bed 301 that is substantially aligned with line T. Width of bed 301 or mattress 300 is the maximum dimension measured parallel to line T.

Bed 301 or mattress 300 can further be oriented with respect to a line Z, which is perpendicular to the plane formed by lines L and T and generally corresponds to the direction associated with the height dimension of bed 301 or mattress 300. The height of bed 301 or mattress 300 is the maximum dimension measured parallel to vertical line Z.

Bed 301 and wheelchair 101 have a support surface with interwoven support elements 113, 114, 313, 314 that are functionally similar in many respects. Both can quickly and easily provide a custom fit support surface that is capable of offloading pressure from tissue at and near boney prominences. All descriptions in this disclosure referring to transverse support elements 113 and longitudinal support elements 114 of seat cushion 100 equally apply to features of transverse support elements 313 and longitudinal support elements 314 of mattress 301.

FIGS. 1, 2, 6 and 7 show a first exemplary embodiment of a wheelchair 101 with a seat cushion 100. The seat cushion 100 generally comprises a perimeter frame 109 with interwoven support elements 111 suspended on the perimeter frame 109. Perimeter frame 109 has members 110*a*, 110*b*, 110*c*, 110*d* that are contoured and are preferably substantially rigid. The interwoven support elements 111 forms the weight-bearing surface 112 for the user 108 of the chair (shown in FIG. 2). As shown in the embodiment illustrated in FIG. 7, the interwoven support elements 111 are made of intersecting transverse interwoven support elements 113 and longitudinal interwoven support elements 114. The interwoven support elements 113, 114 can be loosely woven, i.e. without attachment to each other. A plurality of voids 119 can be formed between the interwoven support elements 113,114.

The pattern for the interwoven support elements 113, 114 can be a "plain weave" (also known as a "tabby weave") where, for example, a transverse interwoven support element 113 is woven over-and-under succeeding longitudinal interwoven support elements 114. Other weaves for the interwoven support elements 113, 114 are also possible. Weaves such as a satin weave, twilled weave or basket weave are specifically contemplated, however others are possible. In an exemplary embodiment, interwoven support elements 113, 114 are adjustable, thereby allowing for change in the contours of the weight-bearing surface 112 when a user 108 sits on the seat cushion 100.

As shown in FIG. 3, mattress 300 has perimeter frame 309 with members 310*a*, 310*b*, 310*c*, and 310*d*. The interwoven support elements 311 form the weight-bearing surface 312 for the user 308 of the bed (shown in FIG. 5). In an exemplary embodiment, weight-bearing surface 112, 312, formed of interwoven support elements 113, 114, 313, 314, overlies the respective perimeter frame 109, 309. The interwoven support elements 313, 314, shown in FIG. 4, can be woven in a plain weave with intersecting transverse interwoven support elements 313 and longitudinal interwoven support elements 314. Weaves such as a satin weave, twilled weave or basket weave are specifically contemplated, however others are possible. In an exemplary embodiment, interwoven support elements 313, 314 are adjustable, thereby allowing for change in the contours of the weight-bearing surface 312 when a user 308 lies on the mattress 300.

The Frame

Figure 7:
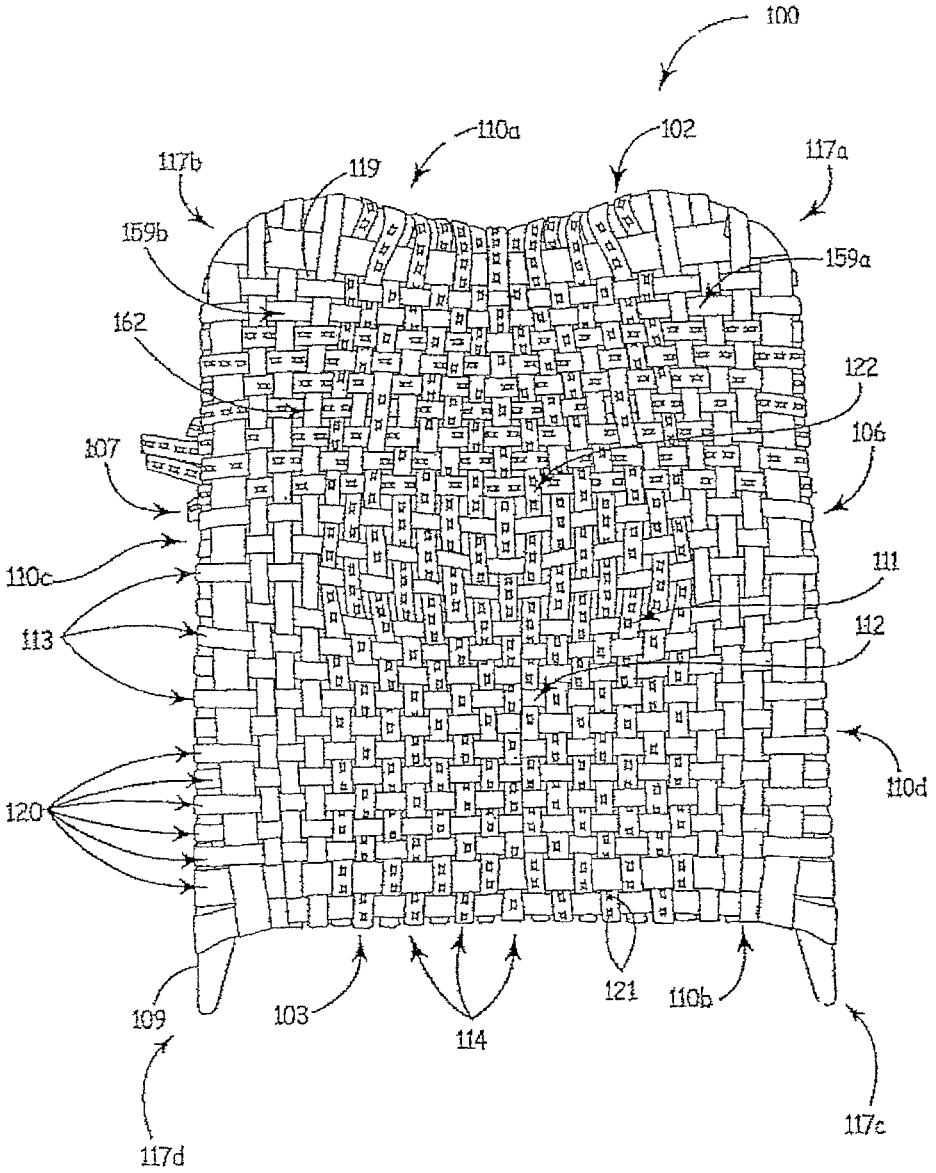
FIG. 7 is a plan view of the seat cushion of FIG. 1.

As shown in FIG. 7 for seat cushion 100, perimeter frame members 110*a*, 110*b*, 110*c*, 110*d* form the perimeter frame 109 structure from which the interwoven support elements 111 transverse interwoven support elements 113 and longitudinal interwoven support elements 114 are suspended. In an exemplary embodiment, the perimeter frame 109 has a substantially rectangular configuration (although the frame can be differently curved than shown). This configuration allows for the creation of a substantially rigid perimeter frame 109 that performs consistently through repeated use cycles. In an exemplary embodiment, each of front frame member 110*b*, lateral frame members 110*c*, 110*d* and rear frame member 110*a* is tubular.

Figure 2:
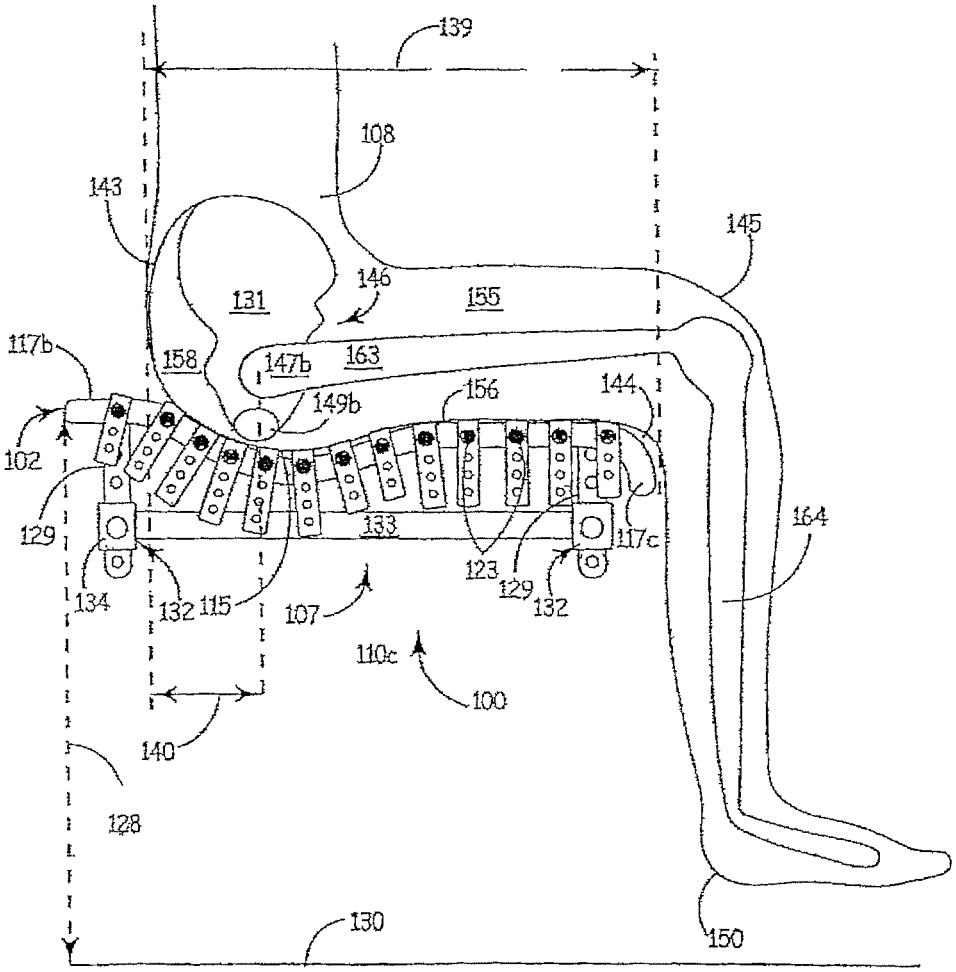
FIG. 2 is a partial side elevation view of a wheelchair user on wheelchair seat cushion of FIG. 1.

In an exemplary embodiment, as shown in FIG. 2, the lateral contoured perimeter frame members 110*c*, 110*d* can form mild "s-curves" in planes parallel to the L-Z plane. When positioned on a wheelchair 101, the lateral perimeter frame members 110*c*, 110*d* can have a downward curving front portion at front left corner 117*c* and front right corner 117*d*, a substantially straight second portion proximate the user's thighs 155, a concave curve portion or depression 115 proximate the user's greater trochanters 131 and a rear portion. In an exemplary embodiment, the bottom of depression 115 is lower than the second portion and lower than the rear portion. Depression 115, as well as the adjustment of the length of the interwoven support elements 113, 114, contributes to proper weight and pressure distribution. Pressure distribution means how a load (often a sitter's weight) is distributed over an area.

The seat cushion's contoured perimeter frame 109 can be especially effective in creating a weight-bearing surface that can manage pressure and shear. The depression in the rear portion of the lateral perimeter frame members 110*c*, 110*d* permits the creation of a weight-bearing surface with more pronounced rises in the front and/or rear parts of the pelvic recess. These rises make transferring some (though not necessarily all) pressure onto the underside of the thighs (and posterior lateral gluteal areas) easier, help hold the pelvis in position to maintain postural alignment, and can prevent the forward slide of the pelvis and thighs. Additionally, the depression in the rear portion of the lateral frame members can help prevent the greater trochanters from coming in harmful contact or proximity with the lateral frame members.

Figure 6:
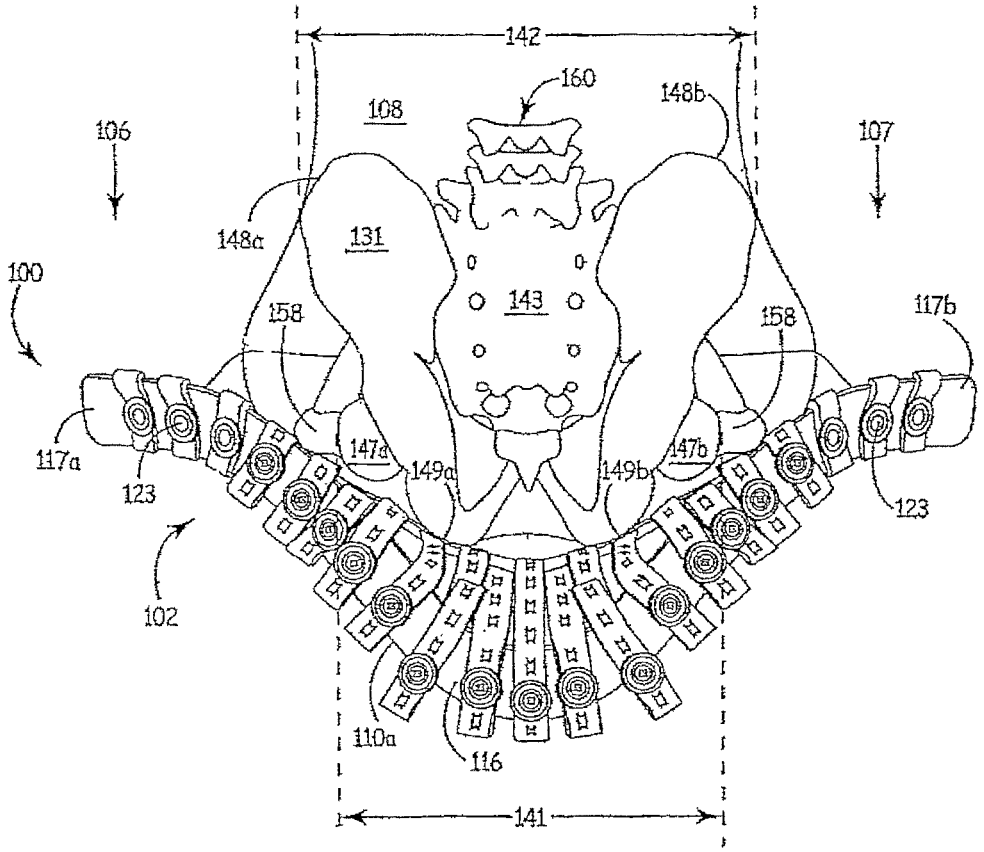
FIG. 6 is rear elevation view of a wheelchair user positioned on the wheelchair seat cushion of FIG. 1.

In an exemplary embodiment, the rear perimeter frame member 110*a* has a central dip portion as shown in FIGS. 1 and 6 shaped like an inverted bell curve in a plane substantially parallel with the T-Z plane. Thus, when positioned on a wheelchair 101, the contour of the rear perimeter frame member 110*a* can have a depression 116 in the middle with higher portions at the rear corners 117*a*, 117*b*. Depression 116, as well as the adjustment of the length of the interwoven support elements 113, 114, can contribute to proper weight and pressure distribution. The shape of the rear perimeter frame member 110*a* with its inverted bell-shaped curve offers several benefits. The sacral region of the user's body with its multiple boney prominences has minimal contact with the weight-bearing surface. Moreover, firm support can be obtained with the posterior-lateral gluteal regions so that load can be transferred to these areas. This enhances the ability to affect pressure distribution, increases pelvic stability, and maintains pelvic orientation (alignment). Finally, the depression in the rear perimeter frame member 110*a* permits the creation of a weight-bearing surface with a less pronounced rise in parts of the pelvic recess proximate the sacrum and coccyx. If a non-contoured frame were deployed, a greater depression in some parts of the interwoven support elements would have to be used to create a depression of similar depth. A non-contoured frame would need to be longer and/or wider to prevent harmful contact or proximity with the user. A longer and/or wider frame can be undesirable due to among other things bulk, weight and size.

In another embodiment, the rear perimeter frame member 110*a* has a curve substantially in the L-T plane. This curve may be configured to ensure that the sacral region of a user's body cannot come in contact with the perimeter frame member 110*a*. A greater depression in some parts of the interwoven support elements could create the proper weight bearing surface.

In an exemplary embodiment, the front perimeter frame member 110*b* generally has limited contour in the T-Z plane. In an exemplary embodiment, the front perimeter frame member 110*b* has a curved front edge as shown in FIG. 2. The curved front edge provides a smooth surface against which the popliteal area 144 of the wheelchair 101 user's knee 145 may rest.

Suitable materials for perimeter frame members 110*a*, 110*b*, 110*c*, 110*d* include, for example, fiber reinforced plastics, injection molded or thermoformed plastics such as acrylonitrile butadiene styrene (ABS) or formed metals such as aluminum or steel. For certain applications in which material costs can be higher and low weight is desired, materials such as titanium or carbon fiber reinforced plastics can be used. For other applications where material costs need to be kept low, other materials may be appropriate.

The perimeter frame 109 can be constructed with other frame elements (not shown) in addition to the perimeter frame members 110*a*, 110*b*, 110*c*, 110*d*. Additional frame elements can provide additional bracing or support or can make attachment of the seat cushion 100 to the wheelchair 101 easier. The perimeter frame 109 to which the interwoven support elements attaches could be fully integrated i.e. the perimeter frame also would be configured for attachment of the wheels, casters, seat cushion back and other items commonly found on wheelchairs. The perimeter frame 109 to which the interwoven support elements attach could itself be configured for attachment to the frame of an existing wheelchair.

As shown in FIGS. 3 and 4 for bed 300, perimeter frame members 310*a*, 310*b*, 310*c*, 310*d* form perimeter frame 309 from which interwoven support elements 311, transverse interwoven support elements 313 and longitudinal interwoven support elements 314 are suspended. In an exemplary embodiment, perimeter frame 309 has a substantially rectangular configuration. This configuration allows for creation of a substantially rigid perimeter frame 309 that performs consistently through repeated use cycles. In an exemplary embodiment, each of front frame member 310*b*, lateral frame members 310*c*, 310*d* and rear frame member 310*a* is tubular. In one embodiment frame members 310*a*, 310*b*, 310*c*, 310*d* are substantially straight. Perimeter frame 309 can be constructed with other frame elements (not shown) in addition to the perimeter frame members 310*a*, 310*b*, 310*c*, 310*d*. Additional frame elements can provide additional bracing or support to perimeter frame 309. Suitable materials for the perimeter frame members 310*a*, 310*b*, 310*c*, 310*d* of bed 301 are similar to those for wheelchair 101. In one embodiment, perimeter frame 309 is made from low cost steel.

The Interwoven Support Elements

The interwoven support elements 111 in one embodiment comprises interwoven support elements 113, 114 suspended on the seat cushion's contoured perimeter frame 109. As mentioned, the interwoven support elements 113, 114 can be interwoven in a plain weave with the interwoven support elements 113, 114 intersecting at approximately ninety degrees at most locations on the weight-bearing surface 112.

In an exemplary embodiment, interwoven support elements 113, 114 are not attached to each other in order to facilitate easy movement of the interwoven support elements 113, 114. However, in certain locations it can be advantageous to restrict the movement of the interwoven support elements 113, 114 relative to each other. This can be done, for example, in order to prevent openings 119 formed between the interwoven support elements 113, 114 from enlarging. For attachment, interwoven support elements 113, 114 can be sewn or spot welded to each other (not shown). Alternatively, it is possible to restrict movement of interwoven support elements 113, 114 relative to each other by using, for example, loops (not shown) or other methods to limit sliding of the interwoven support elements 113, 114 in one direction but not another.

The interwoven support elements 111 can be made of a variety of materials. It is preferable that the interwoven support elements 113, 114 behave consistently over an extended period in a variety of conditions including heat, cold, and high moisture, for example. For most applications, interwoven support elements 113, 114 are flexible but substantially elongationally inelastic (or their elasticity should be predictable through the course of many use cycles). Thus, when an adjustment or fitting is done for a particular user 108, the configuration (including the contours) and performance of the seat cushion 100 can remain relatively consistent for an extended period.

The interwoven support elements 113, 114 have sufficient tensile modulus to support the wheelchair user 108 over an extended time and in a variety circumstances. For some larger users 108, interwoven support elements 113, 114 with a greater tensile modulus may be necessary. In some instances, it may be desirable to have interwoven support elements 113, 114 with different tensile moduli at different locations on the weight-bearing surface 112. For example, it may be desirable to have certain transverse interwoven support elements 113 near the front 103, such that interwoven support elements 120 shown in FIG. 7 have greater tensile moduli than other transverse interwoven support elements 113. This might especially be true for seat cushions fabricated for paraplegic users 108 who may place a hand (not shown) near the front 103 of the seat cushion 100 for advantage when transferring in and out of the wheelchair 101. A mattress 301 may also have some interwoven support elements 113, 114 with a greater tensile modulus. For example it could be advantageous to use interwoven support elements 113, 114 with a greater tensile modulus near an edge of mattress 301 where a user 308 may wish to sit.

The exterior surfaces of the interwoven support elements 113, 114, 313, 314 can have coefficients of friction (COF) intended to achieve certain objectives. Low COFs can permit the interwoven support elements 113, 114, 313, 314 to slide easily relative to each other when weight is placed on the weight-bearing surface 112 or 312. This can ensure that each time a user 108 or 308 sits, leans, twists, or otherwise moves on the seat cushion 100 or mattress 301, the seat cushion 100 or mattress 301 assumes the proper configuration of support for the user's (108 or 308) pelvis and legs. Interwoven support elements 113, 114 with exteriors having high COFs may grip each other and not provide consistent characteristics when the occupant sits or lies on the seat cushion 100 or mattress 301.

In an exemplary embodiment, the interwoven support elements 113, 114 are impervious to moisture and contaminants. Having interwoven support elements 113, 114 with low absorbency also makes cleaning the interwoven support elements 113, 114 easier. Suitable materials for the interwoven support elements 113, 114 can include polyester, nylon, Dacron® or Kevlar®, for example. For many applications, a preferable material is woven polypropylene, which has a relatively high tensile modulus, dimensional stability, and low absorbency.

Many other kinds of interwoven support element materials may also be appropriate. Interwoven support elements 113, 114 may include metallic components or can even be made of wire or metal fabric. Reinforcing with metallic threads for additional strength may also be appropriate. Interwoven support elements 113, 114 can have a laminate construction, coatings, and so forth. Interwoven support elements 113, 114 can have holes 121 for securement to the perimeter frame members 110*a*, 110*b*, 110*c*, 110*d* and/or for added ventilation. Holes 121 may have different shapes.

For most applications, flat interwoven support elements 113, 114 having a rectangular shape may be most suitable. However, many other shapes may be appropriate. Moreover, the interwoven support elements 111 may be made of cords, strings, threads, or even filaments, rather than rectangular webbing.

The length and width of the interwoven support elements 113, 114 can depend on many factors. Interwoven support element length can largely depend on the size of the perimeter frame of the seat cushion 100. The length should be sufficient to span the seat cushion's contoured perimeter frame 109 and to permit adjustment, including the creation of contours in the weight-bearing surface 112 that help achieve the desired pressures. The width of the interwoven support elements 113, 114 can vary. Having a greater number of narrower interwoven support elements 113, 114 can increase the precision of the adjustments made to the interwoven support elements 113, 114. For example, the disclosure contemplates having one inch wide interwoven support elements 113, 114. Having more interwoven support elements 113, 114 can increase the number of adjustments to accommodate a user 108.

In an exemplary embodiment, the interwoven support elements 113, 114 are configured on the perimeter frame members 110*a*, 110*b*, 110*c*, 110*d* as follows. The transverse interwoven support elements 113 are spaced apart and suspended from the lateral perimeter frame members 110*c*, 110*d*. The longitudinal interwoven support elements 114 are spaced apart and suspended from the rear perimeter frame member 110*a* and the front perimeter frame member 110*b*.

The interwoven support elements 113, 114, 313, 314 may be spaced apart such that there are a plurality of voids 119 formed between the interwoven support elements 113, 114, 313, 314. Generally when the interwoven support elements 113, 114, 313, 314 are more closely spaced apart, the plurality of voids 119 are smaller in size than when the interwoven support elements 113, 114, 313, 314 are more openly spaced apart. The interwoven support elements 113, 114, 313, 314 may be spaced apart such that the plurality of voids 119 are relatively small in size. In one embodiment, the interwoven support elements 113, 114, 313, 314 are closely spaced apart such that the plurality of voids 119 are minimized in size. In this embodiment, the interwoven support elements 113, 114, 313, 314 are loosely woven, i.e. without attachment to each other.

With this method, the "active length" of the interwoven support elements 113, 114 can be adjusted. "Active length" for this embodiment means the length of the interwoven support element 113 between two attachment points on opposing frame members 110*a*, 110*b*, 110*c*, 110*d*. It also means that part of the interwoven support element 113 that forms part of the weight-bearing surface 112. By extending or shortening the active length of the interwoven support elements 113, 114, the contours of the weight-bearing surface 112 can be altered. For example, by lengthening or shortening the active length of certain interwoven support elements 113, 114, depressions can easily be formed when weight is placed on the weight-bearing surface 112—such as when a user 108 sits on the seat cushion 100. For example, certain interwoven support elements 113, 114 can be lengthened such that when the user 108 sits on the seat cushion 100, a "pelvic recess" 122 can be formed, as shown in FIG. 7.

Interwoven support elements 313, 314 are similar to interwoven support elements 113, 114 and all descriptions of interwoven support elements 113, 114 are also applicable to interwoven support elements 313, 314. The primary difference is that interwoven support elements 113, 114 are adapted for use for seat cushion 100 while interwoven support elements 313, 314 are adapted for use on mattress 301.

In an exemplary embodiment, interwoven support elements 313, 314 are not attached to each other in order to facilitate easy movement of the interwoven support elements 313, 314 relative to each other. However, in certain locations it can be advantageous to restrict the movement of the interwoven support elements 313, 314 relative to each other. The exterior surfaces of the interwoven support elements 313, 314 can have coefficients of friction (COF) intended to achieve certain objectives.

Interwoven support elements 313, 314 have sufficient tensile modulus to support a bed user 308 over an extended time and in a variety circumstances. For mattress 300 interwoven support elements 313, 314 with a relatively high greater tensile modulus may be desirable. The interwoven support elements 313, 314 (or the interwoven support elements 311 more generally) can be made of a variety of materials. Similar to interwoven support elements 113, 114 it is preferable that the interwoven support elements 313, 314 behave consistently over an extended period in a variety of conditions including heat, cold, and high moisture, for example. For most applications, the interwoven support elements 313, 314 are flexible but substantially elongationally inelastic (or their elasticity should be predictable through the course of many use cycles). Thus, when an adjustment or fitting is done for a particular user 308, the configuration (including the contours) and performance of the mattress 300 can remain relatively consistent for an extended period.

In an exemplary embodiment, the interwoven support elements 313, 314 are impervious to moisture and contaminants. Having interwoven support elements 313, 314 with low absorbency also makes cleaning the interwoven support elements 313, 314 easier. Suitable materials for the interwoven support elements 313, 314 can include polyester, nylon, Dacron® or Kevlar®, for example. For many applications, a preferable material is woven polyester, which has a relatively high tensile modulus, dimensional stability, and low absorbency. Similar to interwoven support elements 113, 114, many other kinds of materials may also be appropriate for interwoven support elements 313, 314. For most applications, flat interwoven support elements 313, 314 having a rectangular shape may be most suitable.

Similar to interwoven support elements 113, 114 the length and width of the interwoven support elements 313, 314 can depend on many factors. The length should be sufficient to span the perimeter frame 309 and to permit adjustment, including the creation of contours in the weight-bearing surface 312 that help achieve the desired pressures. The "active length" of the interwoven support elements 313, 314 can be adjusted to alter the contours of the weight-bearing surface 312. For example, certain interwoven support elements 313, 314 can be lengthened when the user 308 lays on mattress 300, a "pelvic recess" 322 can be formed, as shown in FIG. 5.

In an exemplary embodiment, the interwoven support elements 313, 314 are configured on the perimeter frame members 310*a*, 310*b*, 310*c*, 310*d* as follows. The transverse interwoven support elements 313 are spaced apart and suspended from the lateral perimeter frame members 310*c*, 310*d*. The longitudinal interwoven support elements 314 are spaced apart and suspended from the rear perimeter frame member 310*a* and the front perimeter frame member 310*b*.

In one embodiment, two inch wide interwoven support elements 313 can be used with a center to center lateral spacing of two and one quarter inches. Two inch wide interwoven support elements 314 might be used with a center to center transverse spacing of two and one quarter inches. Two inch wide interwoven support elements 314 might be used with a center to center transverse spacing of two inches. In this embodiment, center to center spacing for all interwoven support elements is substantially similar. For example, on a mattress 301 with a thirty-nine inch width and a seventy-five inch length; thirty two transverse interwoven support elements 313 and sixteen longitudinal interwoven support elements 314 might be used. In another embodiment, interwoven support elements 313, 314 are spaced more closely to eliminate excessive gaps. FIG. 3 and FIG. 4 show similar embodiments of support surfaces upon which the current invention might be used, with differing numbers of interwoven support elements. As shown in FIG. 3, twelve transverse interwoven support elements and six longitudinal interwoven support elements are used. In FIG. 4, nine longitudinal interwoven support elements and sixteen transverse interwoven support elements are used.

The interwoven support elements material can also be relatively thin and provide little insulation. This facilitates heat dissipation, which can be critical because temperature elevation can increase metabolism, with a result that body cells both require more nourishment and produce more waste. If circulation is impaired, either pathologically or mechanically (by ischemia), the rate of tissue damage can increase.

The support surface also provides excellent ventilation, thereby minimizing heat and moisture build-up. The voids in the interwoven support elements provide very direct access to the ambient air, even if a lightweight cover is placed over the interwoven support elements. This contrasts with support surfaces made of various kinds of foam, rubber, gel, liquid, and solid plastics, etc., that inhibit airflow around the weight-bearing surface. Ventilation provided by the open interwoven support elements of the support surface promotes the dissipation of moisture. Moist skin can be more prone to damage and degradation than dryer skin.

The disclosed support surfaces can be easily maintained. Cleaning the interwoven support elements can be easy, especially if the interwoven support elements are non-absorbent. A cover placed on the seat cushion 100 or mattress 300 can be cleaned separately such as in a washing machine.

Interwoven Support Element Fixtures

Figure 8:
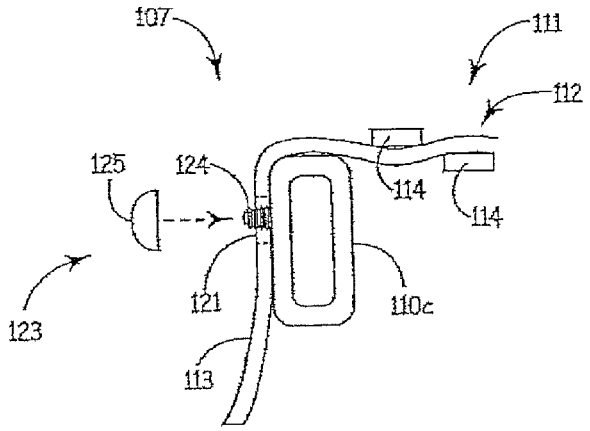
FIG. 8 is a partial front, sectional, elevation view of an exemplary lateral perimeter frame member, showing an exemplary interwoven support element securement mechanism.

The interwoven support elements 113, 114 can be attached to the perimeter frame 109 in a variety of ways. Interwoven support element fixtures 123 can be mounted to perimeter frame members 110*a*, 110*b*, 110*c*, 110*d*, as shown in FIG. 8. In an exemplary embodiment, interwoven support element fixtures 123 have a post 124 and a retainer 125 that resists unintentional dislodgement. Retainer 125 screws on or attaches in other ways to the post 124. Post 124 fits into holes 121 in the interwoven support elements 113, 114 or could penetrate through a woven interwoven support element 113, 114 without a pre-formed hole. In another embodiment, an end of an interwoven support element 113, 114 is attached back onto the interwoven support element 113, 114. Interwoven support elements 313, 314 could be attached to perimeter frame 309 in a similar manner.

Transverse interwoven support elements 113 and longitudinal interwoven support elements 114 need not have holes 121 for adjustment. Fasteners (such as a self-tapping screw) can be used to penetrate through unperforated interwoven support elements 113, 114. Interwoven support elements that have holes for securement often have discrete adjustment intervals. Using a fastener that penetrates an unperforated interwoven support element or using a clamp that does not penetrate a support element can allow for nearly infinite adjustment intervals.

Figure 9:
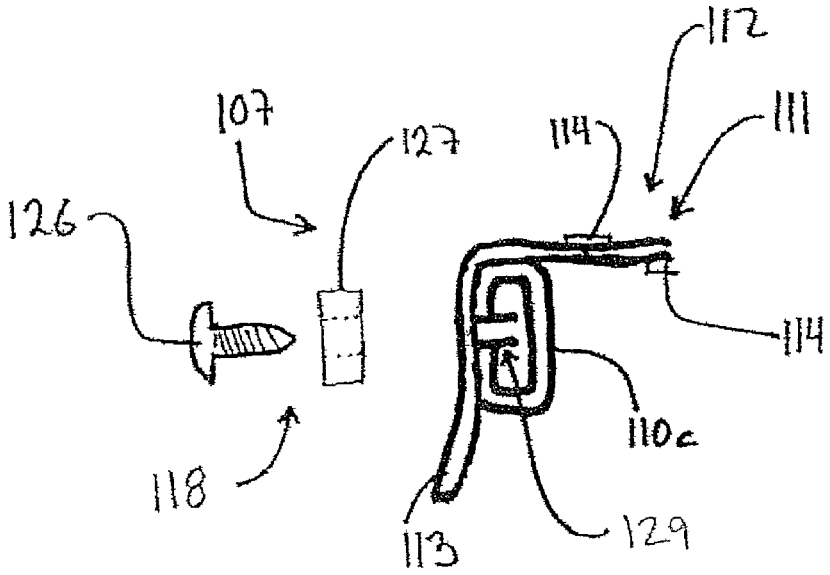
FIG. 9 is a partial front, sectional, elevation view of an exemplary lateral perimeter frame member, showing another exemplary interwoven support element securement mechanism.
Figure 14:
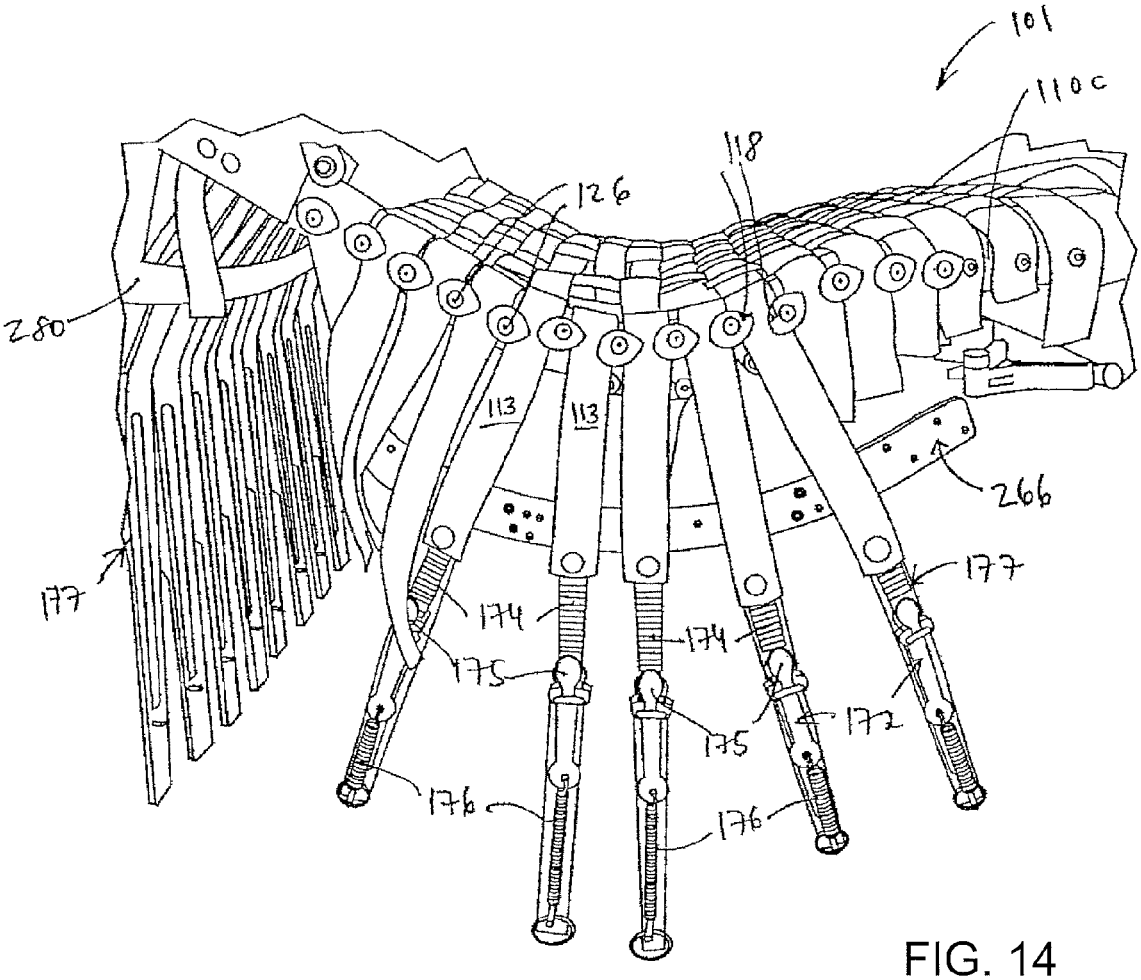
FIG. 14 is a close-up view of a right side of a wheelchair incorporating a second exemplary embodiment of an adjustment apparatus for transverse interwoven support elements of the seat cushion.
Figure 15:
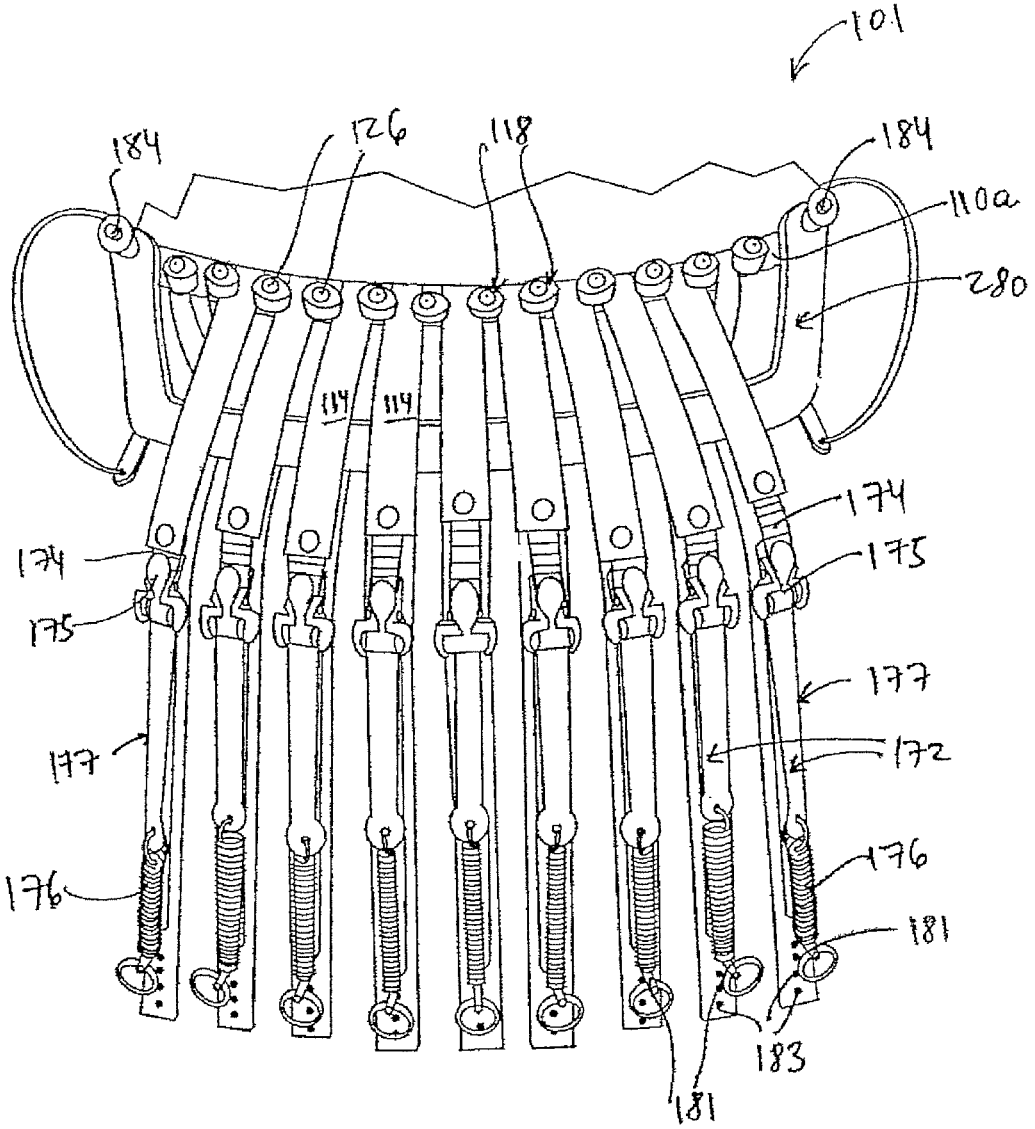
FIG. 15 is a close-up rear view of a wheelchair incorporating a second exemplary embodiment of an adjustment apparatus for longitudinal interwoven support elements of the seat cushion.

As shown in FIG. 9, interwoven support elements 113, 114 may be attached to seat cushion's contoured perimeter frame 109 by frictional engagement without penetrating interwoven support elements 113, 114. Clamps 118 may be used to attach interwoven support elements 113, 114 to perimeter frame members 110*a*, 110*b*, 110*c*, 110*d*. In this embodiment clamps 118 may have a screw 126, a block 127 and an internally threaded aperture 129. Screw 126 fits through block 127 and engages threaded aperture 129. Tightening screw 126 can cause block 127 to bear against interwoven support element 113, 114. Loosening screw 126 such that block 127 no longer bears against interwoven support element 113, 114 facilitates the easy movement of interwoven support elements 113, 114. Screw 126, block 127 and threaded aperture 129 can resist unintentional dislodgement. Screw 126 does not have to penetrate interwoven support element 113, 114; for example, interwoven support elements 113, 114 may be positioned on either side of screw 126 (as shown in FIGS. 14 and 15, for example). In one embodiment, threaded aperture 129 can be formed in frame members 110*a*, 110*b*, 110*c*, 110*d*. In another embodiment a threaded insert could be used to provide threaded aperture 129 in frame members 110*a*, 110*b*, 110*c*, 110*d*. Clamps 118 may also be used to secure interwoven support elements 313, 314 to perimeter frame 309.

Many fixtures 123, clamps 118 and/or means for securement of interwoven support elements 113, 114, 313, 314 that form a weight-bearing surface are also possible. Various fasteners (not shown) including buckles, snaps, hook and loop fasteners, locking cams or cleats a.k.a. jam cleats, other devices designed to join, grip or clamp could be used to attach interwoven support elements 113, 114, 313, 314 to perimeter frame 109 or perimeter frame 309.

Transverse interwoven support elements 113, 313 and longitudinal interwoven support elements 114, 314 need not have holes 121 for securement. Rather, fasteners (such as a self-tapping screw) could be used to penetrate through un-perforated interwoven support elements 113, 114, 313, 314. Interwoven support elements 113, 114, 313, 314 that have holes for securement often have discrete adjustment intervals equal to the distance between holes. Using a fastener that secures un-perforated interwoven support element 113, 114, 313, 314 can allow for nearly infinite adjustment intervals. Clamps 118 may allow for nearly infinite adjustment intervals for interwoven support elements 113, 114, 313, 314. While the support element fixture structures of FIGS. 8 and 9 have been described with reference to the perimeter frame 109 of seat cushion 100, they are also applicable to the perimeter frame 109 of bed 300.

Support Surface Cover

Figure 10:
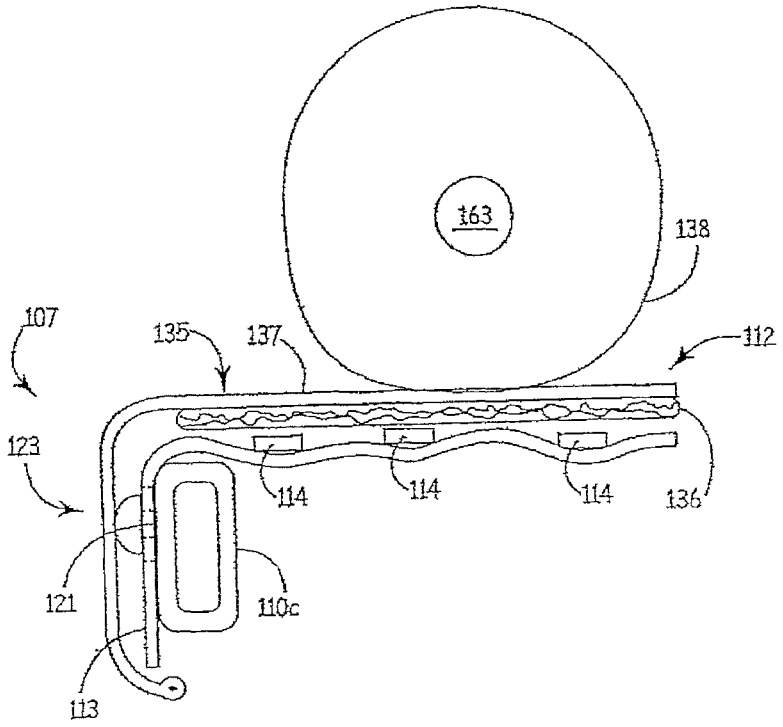
FIG. 10 is a partial front elevation, sectional view of an exemplary cover.

In an exemplary embodiment, seat cushion 100 has a cover 135, a portion of which is shown in FIG. 10. The cover 135 may fit over the entire perimeter frame 109 and weight-bearing surface 112. The cover 135 may have various layers. In an exemplary embodiment, one layer is a pad 136. The pad 136 provides additional cushioning and spreads the load from the wheelchair user 108 among the interwoven support elements 113, 114. One suitable material for the pad 136 is a polyester reticulate-fiber material. Such a material is flexible and durable. The interstices of such a reticulate fiber maintain ventilation. Moreover, the reticulate fibers can be non-absorbent, making the pad easy to clean. Many other materials can also be used for the pad 136.

In an exemplary embodiment, an outer layer 137 covers the pad 136 and is made of a fabric with a low COF. This ensures that the outer layer 137 does not "grab" the skin 138 of the wheelchair user 108 in such a way that increases shear forces. A suitable material for the outer layer 137 includes Lycra® from DuPont, which is not absorbent and easy to clean. Many other materials may be suitable for the outer layer 137. The term "seat cushion" as used herein does not imply that the seat cushion is necessarily soft. Seat cushion 100 can be firm even if seat cushion cover 135 or pad 136 is used. A suitable cover is disclosed in applicants' International Application No. PCT/US2010/031695, published as WO 2010/123857, entitled "Support surface cover having different frictional zones," which is hereby incorporated by reference. A similar cover may be used on bed 301.

Adjustment of Support Surface

For proper fitting of a wheelchair 101 to a user 108, some preliminary measurements can be taken to determine, for example, the proper size of wheelchair or seat cushion frame for a user 108. A first anatomical measurement 139 can be taken from the sacral region 143 to the popliteal region 144 of the knee 145, as shown in FIG. 2. The measurement 139 can be taken when the user 108 is sitting (or recumbent, with the femur 163 and tibia 164 positioned so that the hips 146 and knees 145 are flexed to approximately 90 degrees). The measurement 139 can be useful for determining the length of the seat cushion 100.

A second anatomical measurement 140 can be taken from the sacral region 143 to the front (distal aspect) of the greater trochanters 147*a*, 147*b*, as shown in FIG. 2. The measurement 140 can be taken when the user 108 is sitting (or recumbent, with hips 146 and knees 145 flexed to 90°). The measurement 140 can be useful for determining the position of the pelvic recess 122 on the weight bearing surface 112 and, in particular, the location at which the pelvic recess 122 should begin to rise toward the front 103 of the seat cushion 100. It can also be referred to as the "sacral-greater trochanter" measurement 140.

A third anatomical measurement 141 can be the distance between the lateral aspects of each greater trochanter 147*a*, 147*b*, as shown in FIG. 3. The measurement 141 can be taken when the user 108 is sitting (because the tissue may spread). The measurement 141 can be useful for determining the width of the seat cushion 100.

A fourth anatomical measurement 142 can be from the left anterior superior iliac spine (ASIS) 148*a* to the right ASIS 148*b*. The measurement 142 can be taken when the user 108 is positioned as shown in FIG. 3. The measurement 142 can be useful for approximating the distance between the lateral aspects of the ischial tuberosities 149*a*, 149*b* and hence the location on the seat cushion 100 at which the pelvic recess 122 should begin to rise toward the left and right sides of the seat cushion 100. It can also be referred to as the "ASIS span" measurement 142.

It may be desirable to have a fifth anatomical measurement (not shown) of the distance from the popliteal region to the bottom of the heel 150 while the user 108 is sitting. Such a measurement can be useful in estimating the seat cushion-to-floor height 128 relative to floor 130 (and the position of the footrest 161 of the wheelchair 101) and in making an initial adjustment of the attachment hardware 132 for attaching the seat cushion 100 to the wheelchair 101. Still other measurements can include the elbow (not shown) to weight bearing surface 112 and the weight bearing surface 112 to the top of the head (not shown).

For certain wheelchair users 108, the measurements mentioned above may need alteration. For example, a wheelchair user 108 may have an asymmetrical pelvis 131 or may have a dislocated hip 146. For such users 108, measurements may need to be adapted or special measurements may need to be taken.

For the proper fitting of a bed 301 to a user 308, as shown in FIG. 5, some preliminary measurements can be taken to determine, for example, the proper size of mattress 300 for a user 308. A first useful anatomical measurement 340 is overall height of user 308. This measurement 340 of height can be useful for determining the length of mattress 300. A second anatomical measurement is the width (not shown) of user 308 in a supine position. With the user positioned as shown in FIG. 5 on bed 301, width is typically measured in the transverse direction. The width of user 308 measurement can be useful for determining the width of mattress 300. A third useful anatomical measurement is the weight (not shown) of user 308. The weight of the user can be useful for determining the required strength of the bed 301 construction.

When the weight of a user is supported by a bony prominence, the skin and tissues under the skin can experience very high load pressures between the bone and the support surface. Accordingly, the interwoven support elements of a support surface can be adjusted to distribute the load to other areas, such as under the thighs, some portions of the torso and the fatty portions of the buttocks. High pressure loads are often experienced near areas of bony prominences such as the coccyx, cranium 390, scapula 391, sacrum 392, ischial tuberocities 149*a*, 149*b*, greater trochanters 147*a*, 147*b*, elbow and heel bone (calcaneus) 394.

On a conventional wheelchair seat cushion, very high pressure is experienced near the ischial tuberosities 149*a*, 149*b*. After adjustment as disclosed herein to form a pelvic recess 122 as the area of lowest elevation on the seat cushion 100, pressure is significantly reduced near the ischial tuberosities 149*a*, 149*b*, which are preferably proximate the bottom of the pelvic recess 122. There is a pronounced rise in elevation on the front side 103 of pelvic recess 122. The purpose of this rise on the front side 103 of the pelvic recess 122 can be twofold. Gravity can cause the user's pelvis 131 and thighs 155 to slide forward in the seat cushion 100. This action can shear tissue and be very harmful. The rise on the front side 103 of the pelvic recess 122, combined with the overall upward tilt of the seat cushion 100, can resist this sliding. Moreover, the rise on the front side 103 of the pelvic recess 122 helps unload pressure from the ischial tuberosities 149*a*, 149*b* onto the proximal thigh region 156 thereby creating a "proximal thigh fulcrum." Especially for users 108 whose hamstring muscles (not shown) have atrophied, the rise on the front side 103 of the pelvic recess 122 transfers pressure onto the proximal thighs 156.

For most wheelchair users 108, the weight-bearing surface 112, overall, should be level or have a rearward tilt. For users 108 with significant muscle atrophy, the difference in elevation from the lowest point in the pelvic recess 122 to the highest point may be greater. Seat cushion 100 is particularly well suited for creating the pronounced rise on the front side 103 of the pelvic recess 122. A rise in the lateral perimeter frame members 110*a*, 110*b*, 110*c*, 110*d* allows the creation of a firm "shelf" under the proximal thighs 156 for offloading pressure from boney prominences of the posterior onto the proximal thighs 156. Weight bearing surfaces 112, 312 are adjustable using adjustment mechanisms 166, 167, 172, 180, 186, 266, 280, 366, and 380 described below.

Figure 11:
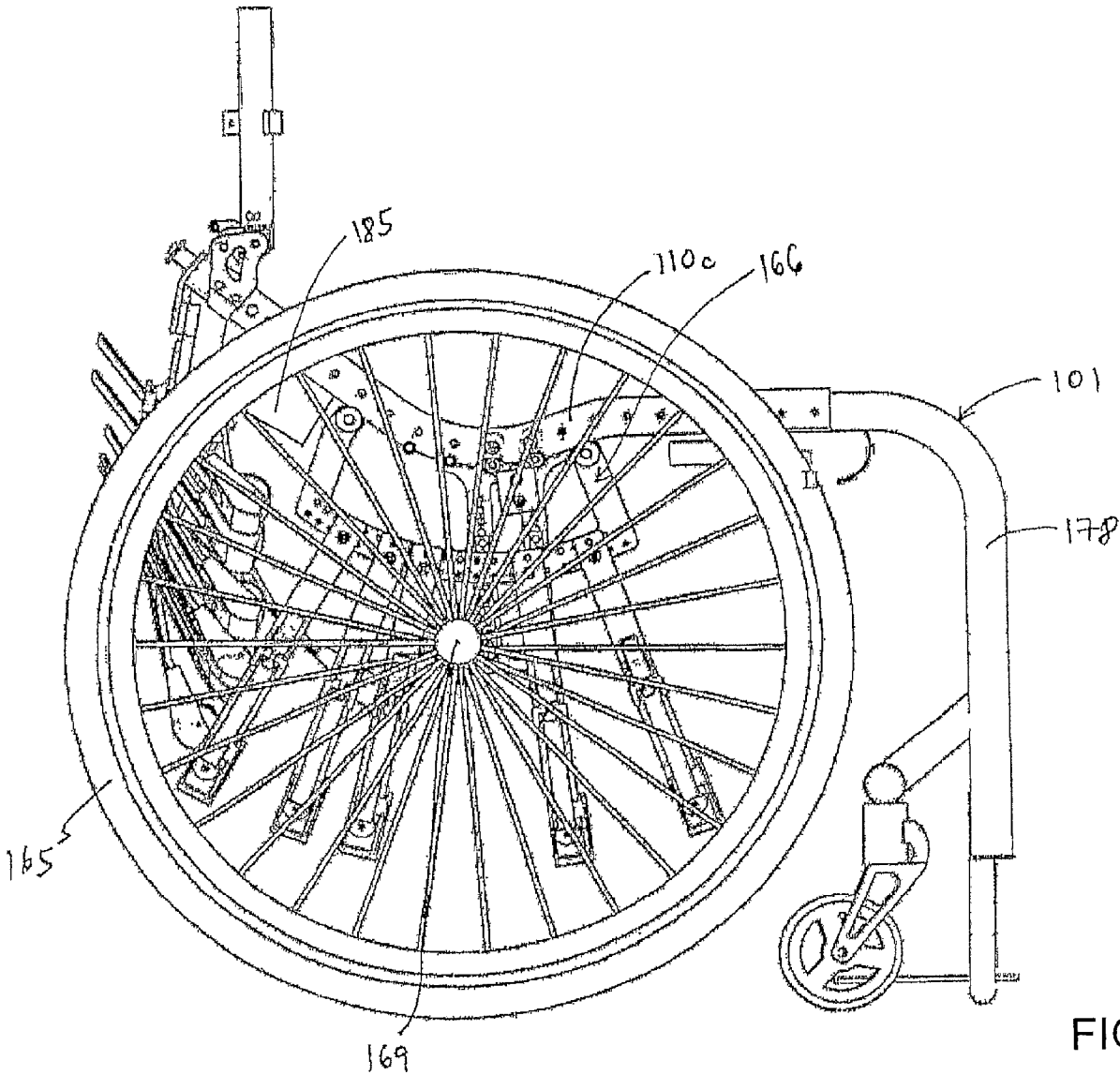
FIG. 11 is a right side elevation view of a wheelchair incorporating a first exemplary embodiment of an adjustment apparatus for transverse interwoven support elements of the seat cushion.
Figure 12:
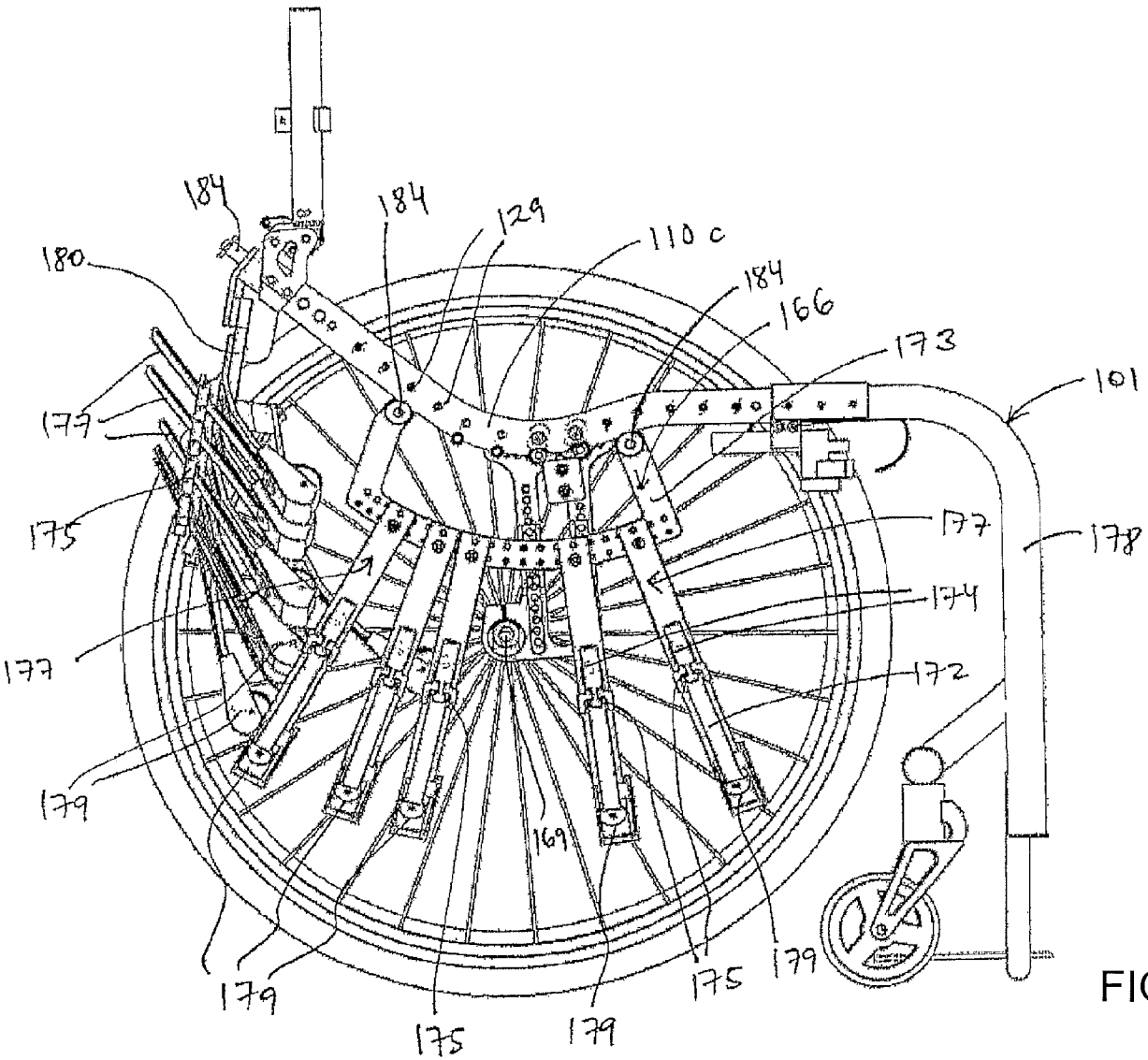
FIG. 12 is similar to FIG. 11, but the right wheel has been removed for a clearer view of the first embodiment of adjustment apparatus for transverse interwoven support elements of the seat cushion.
Figure 13:
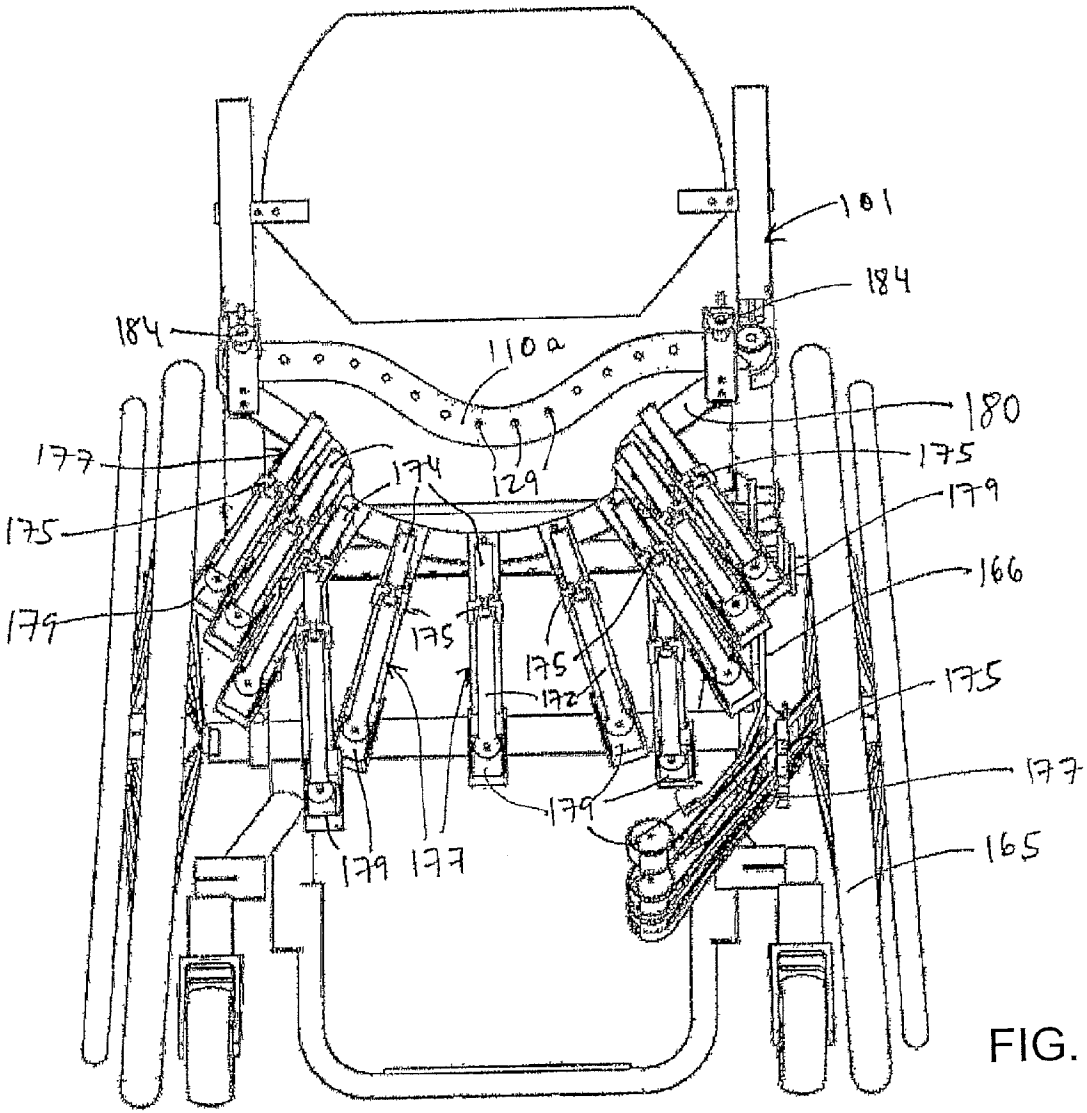
FIG. 13 is a rear elevation view of a wheelchair with a first exemplary embodiment of an adjustment apparatus for longitudinal interwoven support elements of the seat cushion.

FIGS. 11-13 show wheelchair 101 incorporating a first exemplary embodiment of automatic adjustment apparatus including adjustment mechanism 166 for at least some of transverse interwoven support elements 113 and adjustment mechanism 180 for at least some of longitudinal interwoven support elements 114. It is to be understood that an adjustment apparatus as disclosed may also be used in interwoven support elements that are disposed at other angles (i.e., support elements that are not positioned longitudinally or transversely). The interwoven support elements 113 and 114 are not shown for clarity. It is understood that in use, interwoven support elements 113 and 114 would be attached to perimeter frame members 110*a*, 110*b*, 110*c*, and 110*d*, (see FIG. 7) such as with the use of clamps 118 (see FIG. 9) through internally threaded apertures 129 to form seat cushion 100. FIG. 12 is similar to FIG. 11, except that the right wheel has been removed from axle 169 for clarity of description.

As illustrated in FIG. 12, adjustment mechanism 166 includes a chassis 173 connected to right lateral perimeter frame member 110*c* with quick release fasteners 184. Chassis 173 has extensions 177 thereon angled so that each transverse interwoven support element 113 extending around the contoured lateral perimeter frame member 110*c* and down to ratchet mechanism 175 will be pulled substantially perpendicular to the contour of the lateral perimeter frame member 110*c* at the particular location of the transverse interwoven support element 113. Adjustment mechanism 166 includes a plurality of tensioned adjustment straps 172, each attached to an extension 177. An exemplary tensioned adjustment strap includes a commercially available ratchet strap 174 connected to a tensioner such as constant force spring device 179 (explained in more detail with reference to FIGS. 16 and 17). Other tensioners include, for example, helical spring 176, friction plate 271, and wrap spring 276, described below. Such tensioners control an amount of force required to change the active length of the connected interwoven support element.

As illustrated in FIG. 13, adjustment mechanism 180 is connected to rear perimeter frame member 110*a* with quick release fasteners 184. Adjustment mechanism 180 has extensions 177 thereon angled so that each longitudinal interwoven support element 114 extending around the contoured rear perimeter frame member 110*a* and down to ratchet mechanism 175 will be pulled substantially perpendicular to the contour of the rear perimeter frame member 110*a* at the particular location of the longitudinal interwoven support element 114. Adjustment mechanism 266 includes a plurality of tensioned adjustment straps 172, each attached to an extension 177. An exemplary tensioned adjustment strap includes a commercially available ratchet strap 174 connected to a tension device such as constant force spring device 179.

FIGS. 14 and 15 show wheelchair 101 incorporating a second exemplary embodiment of automatic adjustment mechanism 266 for at least some of transverse interwoven support elements 113 and a second exemplary embodiment of an automatic adjustment mechanism 280 for at least some of longitudinal interwoven support elements 114.

In an exemplary embodiment, not all of the transverse interwoven support elements 113 need be adjusted by mechanism 166, 266. In particular, certain transverse interwoven support elements 120 near the front of seat cushion 100 are fixed to lateral frame members 110*c* and 110*d* of seat cushion 100. However, as shown in FIG. 14, others of the transverse interwoven support elements 113 are attached at their ends to adjustment mechanism 166, 266.

In the illustrated embodiment, adjustment mechanism 266 consists of a plurality of tensioned adjustment straps 172. Each tensioned adjustment strap 172 consists, in an exemplary embodiment, of a commercially available ratchet strap 174 connected to a tension device such as spring 176, which is in turn secured to wheelchair frame 178 of wheelchair 101. In another embodiment, each of the interwoven support elements 113, 114 itself fits into a one-way mechanism 175 and each interwoven support element 113, 114 is tensioned by a device such as spring 176.

In an exemplary embodiment, adjustment mechanisms 166, 288 and 180, 280 are easily attachable to and releasable from wheelchair 101, such as with the use of quick release fasteners 184 on perimeter frame members 110*a*, 110*b*, 110*c* and 100*d*. Especially suitable fasteners include quick release pins commercially available from McMaster-Carr of Chicago, Ill. In another embodiment, adjustment mechanisms 166, 266 and 180, 280 may attach to another part of wheelchair 101, such as wheelchair frame 178. Seat cushion 100 and adjustment mechanisms 166, 180, 266, 280 do not need to be integrated with a frame of a wheelchair 101. Seat cushion 100 and adjustment mechanisms 166, 180, 266, 280 can be removable after use to eliminate unnecessary weight. Moreover, adjustment mechanisms 166, 180 can be reused on other wheelchair 101 or bed 300 devices. While adjustment mechanisms 166, 288 and 180, 280 are illustrated with respect to wheelchair, the descriptions herein are equally applicable to their use on bed 300. Moreover, an adjustment mechanism 166, 288 or 180, 280 need not include a chassis from which extensions 177 extend; rather, extensions 177 may extend from the frame of the wheelchair 101 or bed 300 itself.

When user 108 sits upon seat cushion 100, the user's weight causes interwoven support element 113, 114 to pull upon tensioned adjustment strap 172. Because of the one-way mechanism 175 of ratchet strap 174, the interwoven support element 113, 114 is allowed to lengthen (i.e., the active length of the interwoven support element increases), and the adjusted length is automatically maintained. Tensioning devices such as helical spring 176 or constant force spring device 179 are provided to control the amount of force required to lengthen each interwoven support element 113, 114.

In an exemplary method of using automatic adjustment mechanism 166, 167, 172, 180, 186, 266, 280, 366, or 380, a user 108, 308 sits or lies upon seat cushion 100 or mattress 301. The adjustment mechanism 166, 167, 172, 180, 186, 266, 280, 366, or 380 changes the active length of the connected interwoven support elements 113, 114, 313, 314 in response to weight of the user bearing upon the weight bearing surface 112, 312. In an exemplary embodiment, a wheelchair user 108 leans forward and backward and from side to side to assure that a depression is formed in the contours of seat cushion 100 offering comfort in all seating postures. Pressing down into the chair can help the user 108 to exaggerate the pressures of the user's anatomy on the seating surface, if so desired. As the movements are made, each one-way mechanism 175 allows the corresponding interwoven support element 113, 114 to lengthen and retain its length.

During the process of seat cushion 100 adjustment, frictional forces exist between transverse interwoven support elements 113 and longitudinal interwoven support elements 114. Friction forces also exist between interwoven support elements 113, 114 and perimeter frame 109. Frictional forces may influence the adjustment process. One method for reducing the effect of frictional forces on the adjustment process is to occasionally remove the weight of user 108 from seat cushion 100 during the adjustment process. Another method of reducing the effect of frictional forces on the adjustment process is to have the user shift or "rock" slightly during the adjustment process. In practice even users 108 with some level of disability are able to perform shifting or "rocking" maneuvers without causing erroneous adjustments of seat cushion 100.

Another method of reducing the effect of frictional forces on the adjustment process is to apply mechanical vibrations to perimeter frame 109. Mechanical vibrations allow interwoven support elements 113, 114 to slip more freely during the adjustment process. In one embodiment, a vibrator 185 (shown in FIG. 11) is activated for short intervals during the adjustment process. In an exemplary embodiment, vibrator 185 is attached to perimeter frame 109. In an exemplary embodiment, vibrator 185 is powered by air or electricity and is capable of forces of approximately 300 lbs. Differently sized vibrators 185 may be needed for different applications depending on many factors such as the weight of user 108, frictional characteristics of interwoven support elements 113, 114 and the stiffness of perimeter frame 109.

When a fitter is satisfied that the seat cushion 100 has properly conformed to the user's needs, each interwoven support element 113, 114 can be secured to the perimeter frame 109 of the seat cushion 100, as discussed above with reference to FIG. 8 or 9, for example. Thereafter, the ends of each of the interwoven support elements 113, 114 can be disconnected from tensioned adjustment strap 172. One method of disconnecting interwoven support elements 113, 114 from tensioned adjustment strap 172 is by cutting.

In another embodiment, interwoven support element 113, 114 can be connected to ratchet strap 174 using a removable fastener. Several fasteners have been contemplated such as clasps, hook and loop fasteners, curtain fasteners, latches, hooks, rivets, screws and mechanical snaps. In one embodiment ratchet strap, 174 may be shaped such that one end forms a barb, where the barb can engage a hole in interwoven support element 113, 114. A ratchet strap 174 with a barb can be configured to disconnect relatively easily from interwoven support element 113, 114 when the fitter desires to disconnect tensioned adjustment strap 172.

The one-way mechanism 175 of ratchet strap 174 can be any type of one-way device that can hold against tension device 178 and retain the seat cushion 100 shape by maintaining the length of the loosened interwoven support elements 113, 114. Examples of suitable one-way mechanisms 175 include but are not limited to ratcheting drums, drums with wrap springs, ratcheting gear racks and sliding buckles. One-way mechanism 175 of ratchet strap 174 is preferably one that allows the lengthening of interwoven support element 113, 114 in one direction but also allows a manual correction in either direction if needed. In another embodiment, the mechanism is not a one-way mechanism but rather is a two-way mechanism with a lock to hold the adjusted length. In one embodiment, clamps 118 are used as locks to maintain the adjusted active lengths of interwoven support elements 113, 114.

Use of a tensioning device such as helical spring 176 or constant force spring device 179 allows for customization of the interwoven support element tension for different areas. For example, each of the springs 176, 179 can be adjusted or selected for the particular interwoven support element 113, 114. A lighter spring tension may be provided for the interwoven support elements under vulnerable areas of user's anatomy, such as those areas proximate bony prominences, while a heavier spring tension can be provided on interwoven support elements that can be more supportive, such as those under fattier areas of the user's anatomy. Moreover, springs 176, 179 facilitate the finest tuning adjustments of the seat cushion 100 because they allow the interwoven support elements to return easily when the ratcheting one-way lock is disengaged. While helical spring 176 and constant force spring device 179 are illustrated, the tensioning device can also be various other types of springs, pneumatic or hydraulic actuators, elastic bands, drag devices or almost any device capable of creating of forces that oppose lengthening of interwoven support elements 113, 114. Moreover, while springs with different spring constants can be selected, the system can also use uniform springs that are differently preloaded or adjusted. In the embodiment illustrated in FIG. 15, the spring 176 preload can be adjusted by moving peg 181 to different mounting locations 183.

Figure 16:
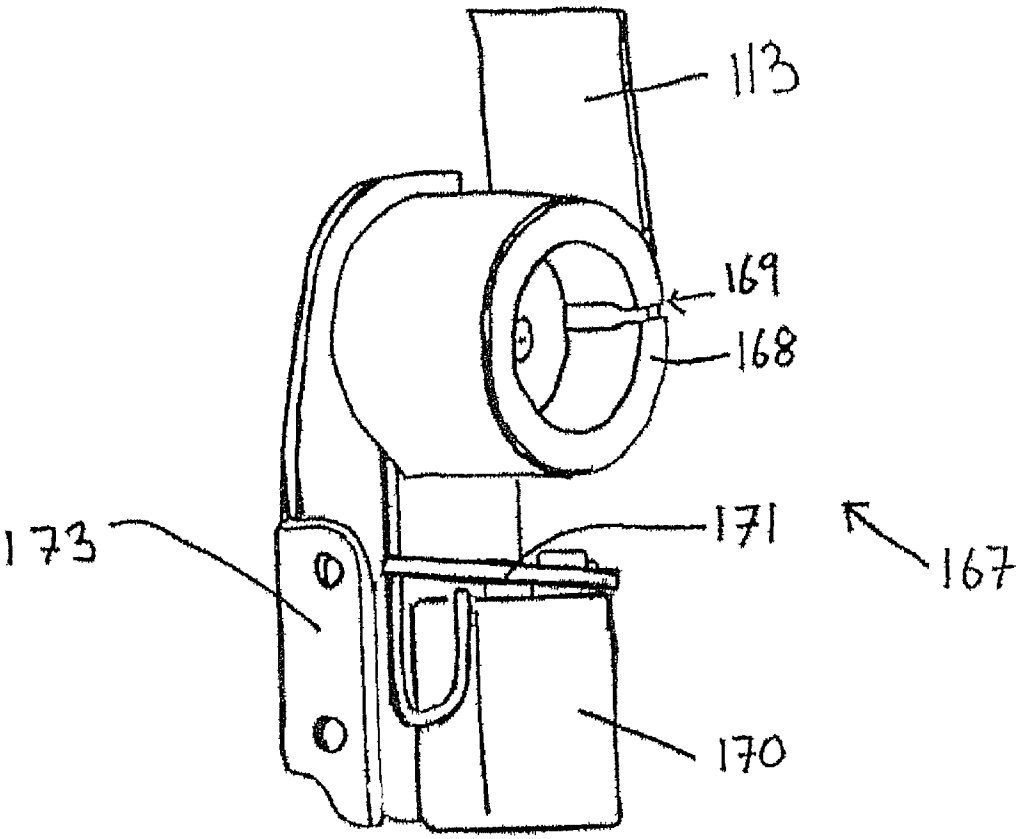
FIG. 16 is a perspective view of an exemplary embodiment of an adjustment apparatus for an interwoven support element.

In another exemplary embodiment shown in FIG. 16, an end of interwoven support element 113, 114 may be attached to rotating drum device 186, which is in turn attached to extensions 177 of adjustment mechanisms 166, 266, 180 or 280. Interwoven support element 113, 114 releasably attaches to rotating drum 168 by engaging slot 169 in drum 168. A tensioning device such as a constant force spring, which is not visible because it is internal to drum 168, may be used to control the rotation of drum 168 and thus the amount of force required to lengthen each interwoven support element 113, 114.

Figure 17A:
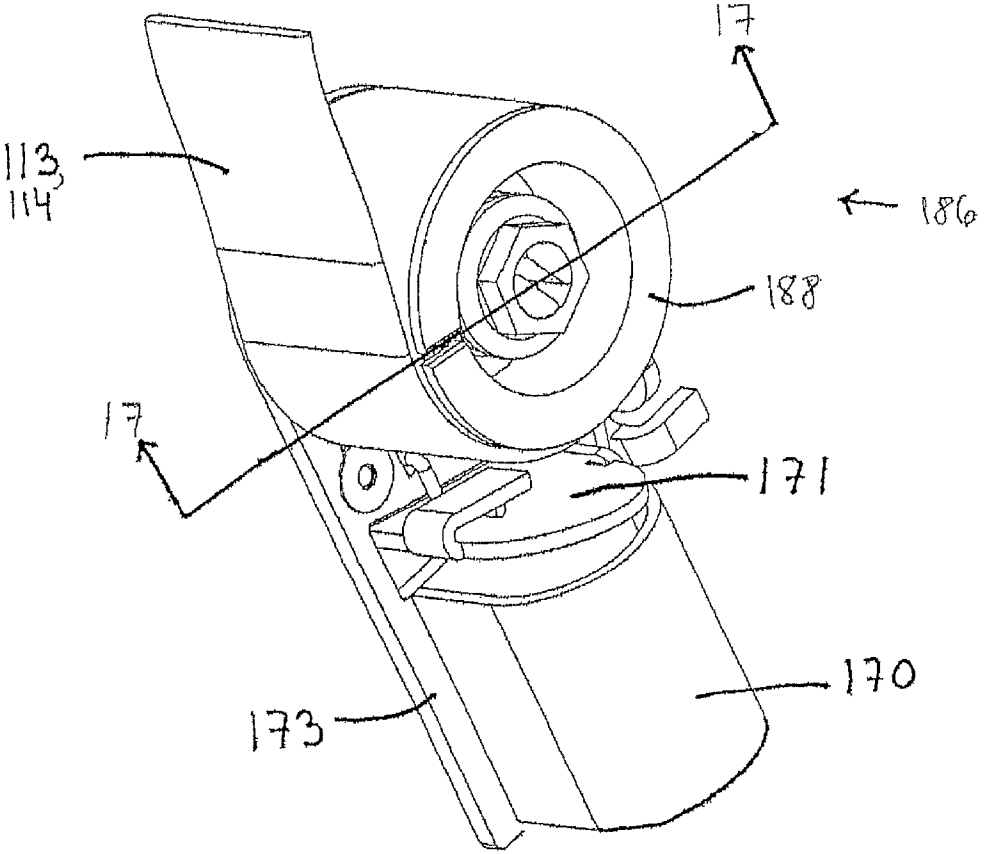
FIG. 17A is a perspective view of another exemplary embodiment of an adjustment apparatus for an interwoven support element.
Figure 17B:
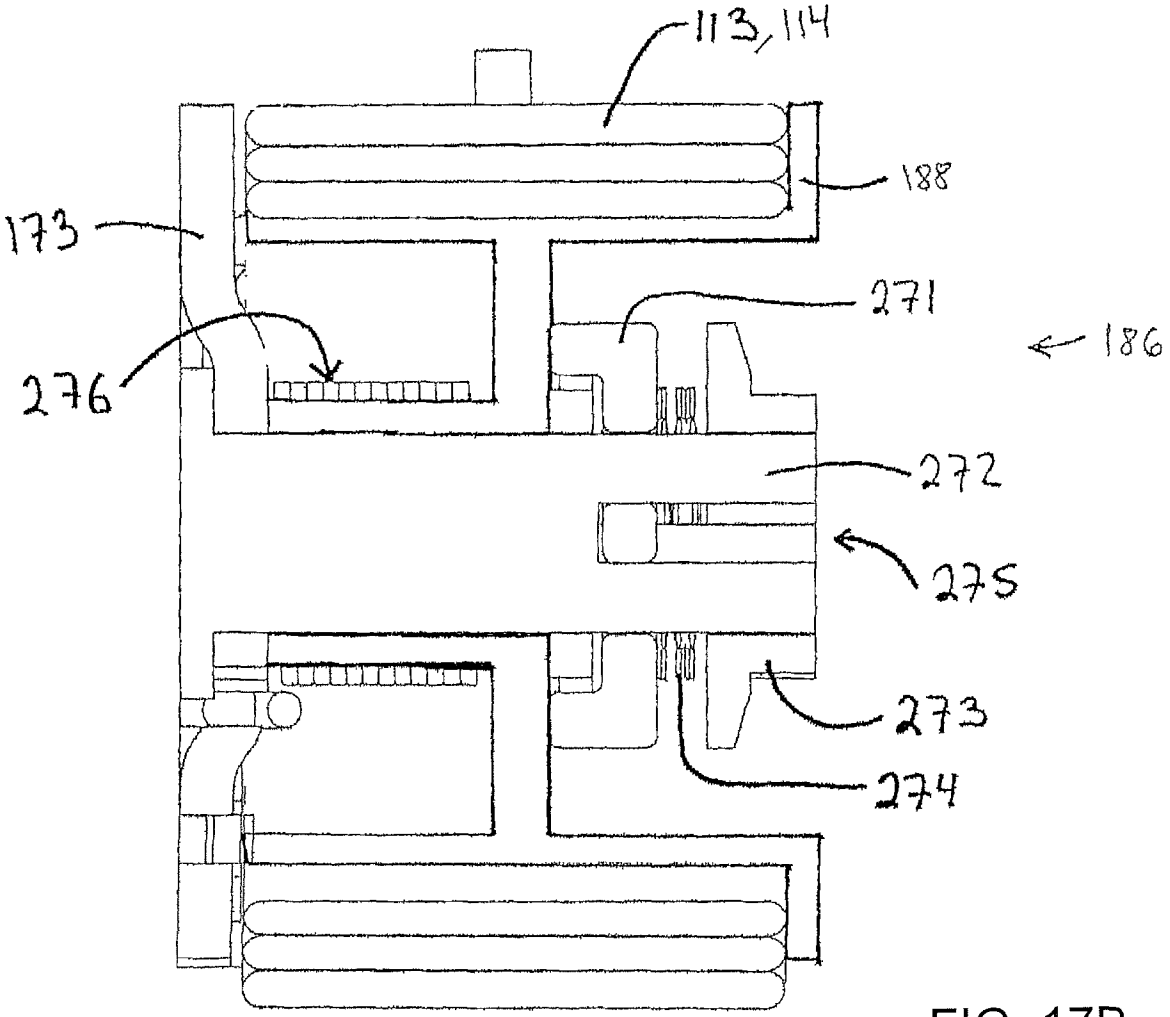
FIG. 17B is a section view along line 17-17, of FIG. 17A of an exemplary embodiment of an adjustment apparatus for an interwoven support element.

In another exemplary embodiment shown in FIGS. 17A and 17B, interwoven support element 113, 114 may be attached to rotating drum device 167, which is in turn attached to extensions 177 of adjustment mechanisms 166, 266, 180 or 280. Rotating drum device 186 may contain a wrap spring 276 that controls rotation of the rotating drum 188. Rotating drum 188 is rotationally attached to chassis 173 by shaft 272. Wrap spring 276 is a normally closed device. Wrap spring 276 is placed in an open state by energizing solenoid 170 or depressing release lever 171. In the closed state wrap spring 276 allows rotating drum 168 to rotate in one direction. In the open state, wrap spring 276 allows rotating drum 168 to rotate in both directions. Solenoid 170 is attached to chassis 173. Chassis 173 may attach to adjustment mechanisms 166, 266, 180, 280; wheelchair frame 178 or perimeter frame 109, 309. Operation of solenoid 170 or release lever 171 allows rotating drum 188 to rotate in both directions or alternatively rotate in one direction.

Rotating drum device 186 may contain a tensioning device that comprises a friction plate 271, partially threaded shaft 272, nut 273 and wave spring 274. Wave spring 274 is compressed against friction plate 271 by nut 273. Friction plate 271 is rotationally constrained with respect to shaft 272 by engagement with slot 275. Friction plate 271 bears upon rotating drum 168. When interwoven support element 113 lengthens, it causes rotating drum 168 to rotate. Frictional forces created by friction plate 271 on rotating drum 168 resist motion of rotating drum 168.

In an exemplary method of using rotating drum device 186, user 108, 308 sits or lies upon seat cushion 100 or mattress 301 with wrap spring 276 in the closed state. In this embodiment, rotating drum device 186 is configured such that when wrap spring is in a closed state, interwoven support element 113, 114, 313, 314 may lengthen and when wrap spring is in an open state, interwoven support element 113, 114, 313, 314 may lengthen or shorten. The weight of user 108, 308 causes interwoven support element 113, 114, 313, 314 to lengthen. The changing active length of interwoven support elements 113, 114, 313, 314 allows depressions to form in seat cushion 100 or mattress 300. When a fitter is satisfied that seat cushion 100 or mattress 300 has properly conformed to the user's 108, 308 needs, each interwoven support element 113, 114, 313, 314 can be secured to perimeter frame 109, 309 as discussed above. Thereafter, each of interwoven support elements 113, 114, 313, 314 can be disconnected from rotating drum device 186.

In another exemplary method of using rotating drum device 186, user 108, 308 sits or lies upon seat cushion 100 or mattress 301 with wrap spring 276 in the closed state wherein rotating drum device 186 is configured such that when wrap spring 276 is in a closed state, interwoven support element 113, 114, 313, 314 may only shorten and when wrap spring is in an open state, interwoven support element 113, 114, 313, 314 may lengthen or shorten. Interwoven support elements 113, 114, 313, 314 do not lengthen with wrap spring 276 in the closed state. Thus, while the user 108, 308 is getting into position on seat cushion 100 or mattress 301, his/her movements do not cause adjustment of the interwoven support elements 113, 114, 313, 314. Once user 108, 308 is properly positioned, solenoid 170 is energized or release lever 171 depressed to place wrap spring 276 in an open state. In an exemplary embodiment, electrical power requirements for solenoids 170 are quite low and can be met with a battery. The weight of user 108, 308 causes interwoven support element 113, 114, 313, 314 to lengthen. The changing active length of interwoven support elements 113, 114, 313, 314 allows depressions to form in seat cushion 100 or mattress 301. In an exemplary embodiment, a rotating drum device 186 is connected to each of the interwoven support elements 113, 114, 313, 314 for which adjustment is desired. In an exemplary embodiment, all of the rotating drum devices 186 of seat cushion 100 or mattress 301 are connected so that all of their respective solenoids 170 are energized simultaneously for adjustment of all applicable interwoven support elements 113, 114, 313, 314 at once. When a fitter is satisfied that seat cushion 100 or mattress 301 has properly conformed to the needs of user 108, 308, the fitter operates solenoid 170 or release lever 171 to close wrap spring 276 and prevent further lengthening of interwoven support elements 113, 114, 313, 314. Each interwoven support element 113, 114, 313, 314 can be secured to perimeter frame 109, 309 as discussed above. Thereafter, each of interwoven support elements 113, 114, 313, 314 can be disconnected from rotating drum device 186.

Rotating drum device 186 could contain devices other than wrap spring 276 while maintaining similar functionality. For example rotating drum device 186 could contain a locking device that would allow drum 168 to rotate in its open state or alternatively not rotate in its closed state.

In an exemplary embodiment, adjustment mechanism 166, 180, 266, 280 has a feedback system. The feedback system can take many forms but, in an exemplary embodiment, the feedback system produces audible signals related to changes in active length of connected interwoven support element 113, 114, 313, 314. Ratchet strap 174 is configured to produce an audible signal. The audible signal can be a "clicking" sound, produced as the active length of interwoven support element 113, 114, 313, 314 increases. In an exemplary embodiment, each click corresponds to a change in interwoven support element 113, 114 active length of approximately one eighth of one inch. The audible signal is produced by a spring loaded pawl and tooth system in ratchet strap 174 and specifically configured to produce a pleasing audible signal. Feedback related to strap adjustment can be provide by many means; specifically contemplated are visible measurement scales, electronic measurement devices and/or convenient measurement or gauging points that relate to changes in active length of corresponding interwoven support element 113, 114, 313, 314. This feedback can be used to quickly and easily determine the amount of interwoven support element adjustment. For example, tensioned adjustment strap 172 or interwoven support element 113, 114, 313, 314 could have a scale thereupon.

In an exemplary method of use of a feedback system, when user sits upon seat cushion 100 or mattress 301, the active length of interwoven support elements 113, 114, 313, 314 increases and a depression is formed in the contours of seat cushion 100 or mattress 301. During the lengthening of interwoven support elements 113, 114, 313, 314, ratchet strap 174 provides an audible signal. Audible signals from ratchet strap 174 indicate interwoven support element 113, 114, 313, 314 adjustments are occurring. When audible signals cease, the automatic adjustment of seat cushion 100 or mattress 301 is likely to be complete or nearly complete.

In another exemplary method of use of a feedback system, after automatic adjustment of seat cushion 100 or mattress 300, a fitter may desire to make further adjustments or "fine tune" the support surface. For example, a fitter may desire to lengthen interwoven support elements 113, 114, 313, 314 proximate a critical area of the anatomy of user 108, 308. Audible signals relate to changes in active length of interwoven support element 113, 114, 313, 314; for example, three "clicks" might correspond to a change in interwoven support element 113, 114, 313, 314 active length of three eighths of one inch. Counting the number of clicks allows a fitter to quickly and easily know the change in length of an interwoven support element 113, 114, 313, 314. These audible signals also allow different interwoven support elements 113, 114, 313, 314 to be easily adjusted by similar amounts or relative amounts.

Feedback in the form of audible signals can be produced by many types of devices. For example audible signals might be made by ratchet strap 174, drum 168, actuators 201 or 202 (shown in FIG. 21), computer 200, one-way mechanism 175 or other devices related to interwoven support element adjustment. In addition to wheelchairs, audible signals are especially useful when adjusting support surfaces such as for beds. Sometimes feedback other than audible signals is preferred, for example when an interwoven support element adjustment occurs while user 308 is asleep. Audible signals may also not be preferred in the case of frequent adjustments.

In an exemplary embodiment, only one adjustment mechanism 166 or 266 for transverse interwoven support elements 113, 313 is needed because one end of transverse interwoven support elements 113, 313 is fixed to or proximate lateral perimeter frame member 110*c*, 110*d*, 310*c*, 310*d*. Similarly, only one adjustment mechanism 180 or 280 for longitudinal interwoven support elements 114, 313 is needed because one end of longitudinal interwoven support elements 114, 314 can be fixed to or proximate front perimeter frame member 110*b*, 310*b*. Alternatively only one adjustment mechanism 180 or 280 for longitudinal interwoven support elements 114, 314 may be needed because one end of longitudinal interwoven support elements 114 could be fixed to or proximate rear perimeter frame member 110*a*, 310*a*. It should be understood that more than one adjustment mechanism 166, 180, 266 or 280 is not always required. In another embodiment, all adjustable interwoven support elements 113, 114, 313, 314 could use a single adjustment mechanism similar to 166, 180, 280 or 266.

In another exemplary embodiment, two adjustment mechanisms 166 or 266 for transverse interwoven support elements 113, 313 are used when it is desirable to adjust both ends of transverse interwoven support elements 113, 313. Similarly two adjustment mechanisms 180 or 280 for longitudinal interwoven support elements 114, 314 could be used when it is desirable to adjust both ends of longitudinal interwoven support elements 113, 314.

Additional steps in adjustment of seat cushion 100 include making an overall assessment of the posture of wheelchair user 108 sitting on seat cushion 100. These observations might include the erectness of the spine 160, position of the backrest 157, and so forth. Another step includes adjusting the footrest 161 height. Generally, the footrest 161 should be low enough so the footrest 161 bears only a minor portion of the lower-leg weight. This ensures that the proximal thighs 156 shown in FIG. 2 bear their intended share of weight and form a proximal thigh fulcrum.

After automatic adjustment of a support surface with interwoven support elements, the fitter can locate any remaining pressure points and fine-tune the seat cushion 100 or mattress 301 by adjusting interwoven support elements 113, 114, 313, 314 as needed. In locating pressure points, the fitter may use pressure mapping systems common in the industry. In many instances, the fitter may only need to loosen or tighten a few interwoven support elements 113, 114, 313, 314. For example, as shown in FIG. 7, if a pressure point is identified at intersection 162 of fourth longitudinal interwoven support element 114 and seventh transverse interwoven support element 113, the fitter may only have to loosen those two interwoven support elements 113, 114.

Ratchet strap 174 preferably allows a manual correction of the length of interwoven support element 113, 114, 313, 314 if needed. Ratchet strap 174 allows for step-wise lengthening of interwoven support elements 113, 114, 313, 314. By step-wise lengthening is meant that lengthening occurs in discrete intervals. Ratchet strap 174 has a lever for lengthening interwoven support elements 113, 114, 313, 314 against tension device 167, 172, 176, 179, 186. A fitter who wishes to fine-tune a strap only has to use the lever of ratchet strap 174 to lengthen interwoven support element 113, 114, 313, 314.

A seat cushion 100 or mattress 301 offers the unique advantage of allowing relatively easy access to underside of the interwoven support elements 113, 114, 313, 314. This access allows a fitter to visually or manually (e.g., tactilely) check an underside of the weight bearing surface 112, 312 to determine if adjustments should be made to a length or tension of any of the interwoven support elements 113, 114, 313, 314. The conforming interwoven support elements 113, 114, 313, 314 allow a fitter or medical professional to easily locate some of the user's anatomical features such as the ischial tuberocities.

The adjustable seat cushion with interwoven support elements can be used to make accurate plaster casts under load bearing conditions of an ideally contoured support surface. CAD/CAM systems used in conjunction with an adjusted support surface with interwoven support elements can make production of other custom fit support surfaces virtually automatic.

Some persons may wish to continue manufacturing prior art support surfaces or manufacture new and novel support surfaces. While a support surface with interwoven support elements may be used as a support surface, it may also be used to help fit other types of support surfaces quickly and easily. Prior art support surfaces are often made from molds taken under non-weight bearing and/or non-ideal conditions and are not themselves easily adjustable. Thus, these prior art custom fit support surfaces often require extensive trial and error modifications to molds to achieve a good fit. Access to idealized support surface contours could reduce the difficulty of manufacturing prior art support surfaces and enable the manufacture of new and novel support surfaces.

Access to the bottom of seat cushion 100 or mattress 301, conforming interwoven support elements 113, 114, 313, 314 and/or the disclosed adjustment mechanisms allow ideal support surface contours to be easily determined. These ideal support surface contours can be determined under weight-bearing conditions. Determination of these ideal support surface contours allows other types of custom fit support surfaces to be made without time consuming modifications.

Figure 18:
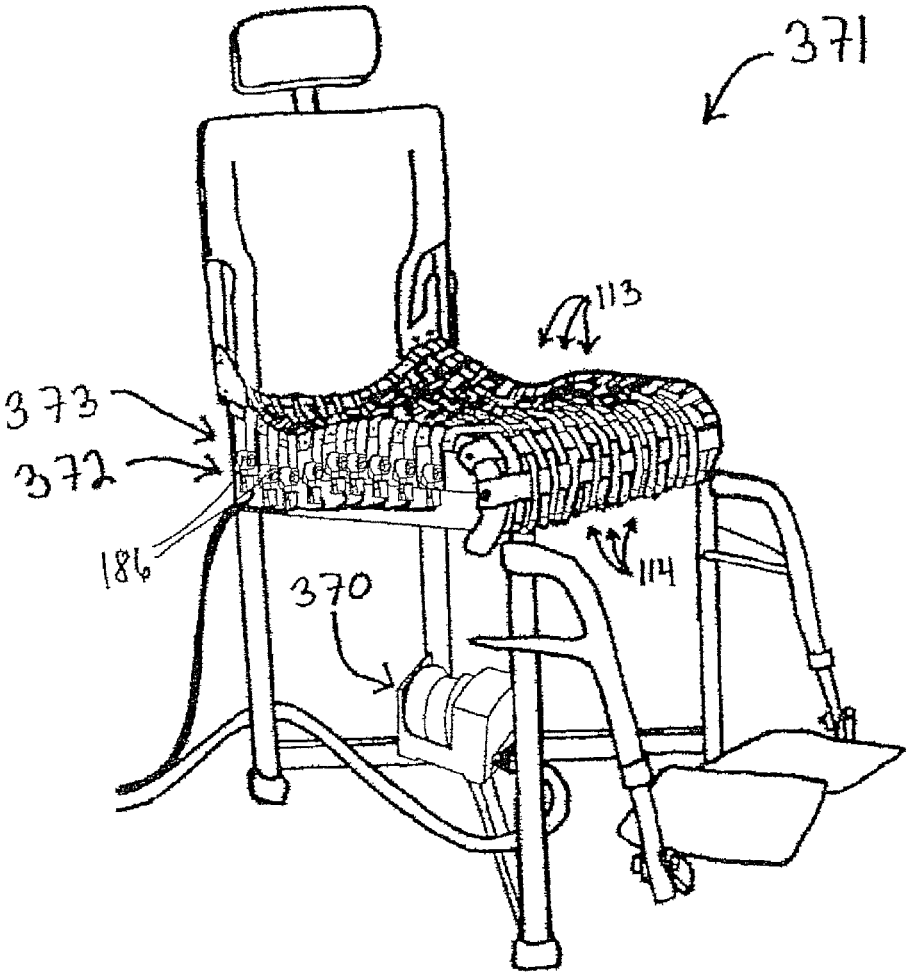
FIG. 18 is a perspective view of an exemplary embodiment of an adjustment apparatus for an adjustable seat cushion with interwoven support elements.

An exemplary use of an adjusted weight bearing surface 112, 312 involves obtaining a plurality of measurements related to a contour of the weight bearing surface. These measurements can then be used to fabricate other support surfaces having the same contour. In one embodiment, shown in FIG. 18, a measuring seat cushion 371 is used to determine interwoven support element 113, 114 lengths. Although it is not shown in FIG. 18 the interwoven support elements 113, 114 have visible length scales upon them. When a fitter is satisfied that measuring seat cushion 371 has properly conformed to the user's needs, the measurements taken from the interwoven support element 113, 114 scales can be recorded. The recorded measurements can be used to create another set of interwoven support elements 113, 114 for a cushion 100 that conforms to the user's needs without further adjustment. A similar process could be used to make interwoven support elements 313, 314 for mattress 301.

Encoders 372 may be used to determine the change in length of interwoven support elements 113, 114. When the interwoven support elements 113, 114 lengthen, the encoders 372 on adjustment mechanism 373 (which comprises a plurality of rotating drum devices 186 connected to interwoven support elements 113, 114) produce information related to the changes in active length of the corresponding interwoven support elements 113, 114. This data could be provided mechanically and/or electronically such that it could be easily used by a fitter and/or computer.

In an exemplary embodiment, one or more laser scanners 370 is attached to measuring seat cushion 371 below the support surface with interwoven support elements. Laser scanners 370 measure distance accurately over a line of sight. By measuring the distance of multiple points on a support surface, a laser scanner can accurately determine contours of the weight bearing support surface. Undulations in a support surface contour may create measurement difficulties for a poorly mounted laser scanner. These difficulties arise due to the ability of a typical laser scanner 370 to only measure over a line of sight. Due to the undulations and depending upon positioning, a laser scanner 370 might not be able to "see" all portions of a support surface. The positioning of a laser scanner needs to be carefully considered such that all necessary portions of a typical adjusted support surface can be seen by the laser scanner 370. This positioning will be appreciated by those skilled in the art. In one embodiment, a single laser scanner 370 is positioned such that all points of a typical support surface contour can be seen by the scanner. It is also contemplated that more than one laser scanner 370 might be used or that a laser scanner 370 could be moved to multiple locations for measurement. A laser scanner 370 can measure support surface contours under weight-bearing conditions, for example with a user upon measuring seat cushion 371.

Interwoven support element length data from encoders 372 attached to adjustment mechanism 373 could be used to check the accuracy of laser scan data. In one embodiment a laser scanner 370 might produce data related to the contour of a support surface with interwoven support elements. Interwoven support element length data from encoders 372 could be compared with laser scanner 370 data for accuracy. This comparison might be performed by several methods. One method would be to compare the change in length of an adjusted interwoven support element to the change in length of a cross section of the support surface contour known to correspond to the approximate location of the adjusted interwoven support element before and after adjustment of a support surface. The change in length of the cross section of the support surface contour could be determined mathematically from the laser scanner 370 data taken before and after adjustment.

Data may be taken from a laser scanner or other scanner related to the support surface contours. This data could be easily transferred over the internet or by other means of communication to a remote manufacturing facility. This data could be provided mechanically and/or electronically such that it could be easily used by a fitter and/or computer to produce another type of custom fit support surface using the measurements of measuring seat cushion 371.

In an exemplary embodiment, CAD/CAM devices are used to quickly and easily build another type of custom fit support surface. By another type of custom fit support surface is meant a support surface that could benefit from being manufactured with the aid of support surface contour data. A user sits upon a support surface with interwoven support elements such as seat cushion 100 or measuring seat cushion 371. Interwoven support elements 113, 114 are adjusted to achieve an ideal support surface contour. The quality of adjustments to the support surface may be verified with a pressure sensor such as a pressure mat. Feedback from encoder 372 or other feedback devices provide interwoven support element 113, 114 length data. A laser scanner 370 mounted proximate the support surface with interwoven support elements can provide contour data. This contour data can be used in conjunction with CAD/CAM systems to robotically manufacture another type custom fit support surface. Manufacture of another type custom fit support surface could be performed via the intermediate step of making a positive (male) or negative (female) mold from the previously collected contour data. However, in this embodiment, another type custom fit support surface is manufactured without an intermediate mold. Another type custom fit support surface could be robotically manufactured using a CNC machine to carve foam or a computerized knitting machine to knit a three-dimensional support surface. There exist a number of devices for determining support surface contours, such as mechanical digitizers, computerized axial tomography, magnetic resonance imaging or optical methods such as 3-D photography or laser scanning, or some combination of these, just to name a few.

In an exemplary method, a support surface with interwoven support elements can be used to make a prior art type impression cast. A user is placed upon a support surface with interwoven support elements, the support surface with interwoven support elements is adjusted and the adjustments can be checked. The user 108 is removed from the weight bearing surface of measuring seat cushion 371 after the active length of at least some of the plurality of interwoven support elements 113, 114 has been changed in response to weight of the user 108 bearing upon the weight bearing surface of measuring seat cushion 371. In an exemplary embodiment, a thin casting element, also called an impression cast, such as one made of plaster or fiberglass, for example, is positioned upon the weight bearing surface of measuring seat cushion 371. The user 108 is positioned upon the casting element, and the casting element is allowed to cure with the user 108 seated upon it, thereby providing a cast impression of user's anatomy and of the weight bearing surface under an ideal weight bearing condition. The cured impression cast can be used to shape a prior art custom fit support surface that will require little to no modification to achieve an ideal fit. While the measurement cushion description has referred to a seat cushion, the disclosed methods of apparatuses are also applicable to other support surfaces, such as a bed mattress, for example.

Figure 19:
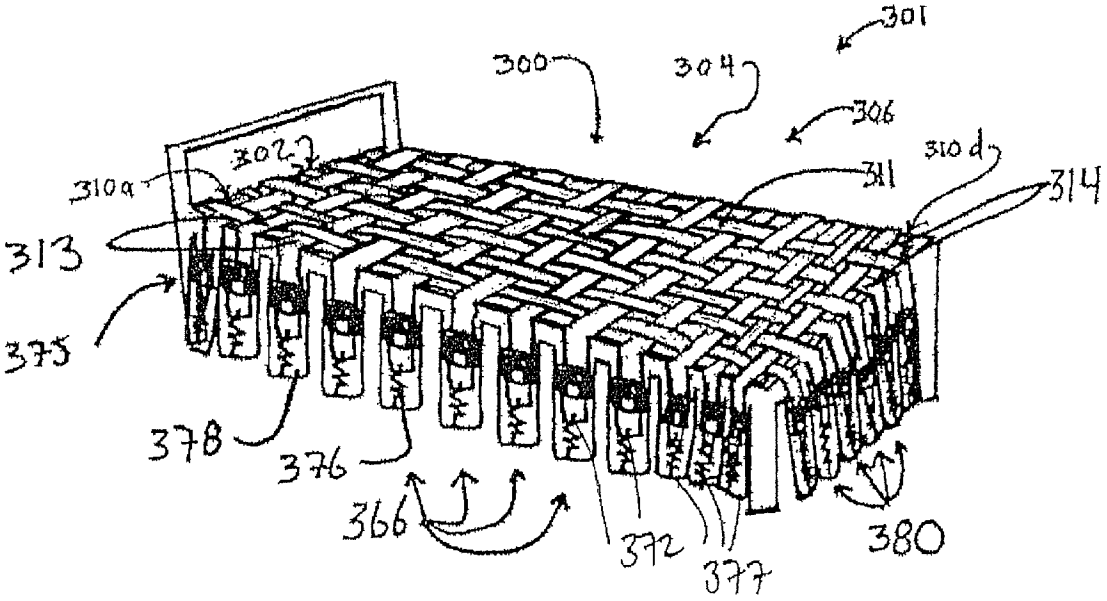
FIG. 19 is a perspective view of an exemplary embodiment of an adjustment apparatus for an adjustable bed with interwoven support elements.
Figure 20:
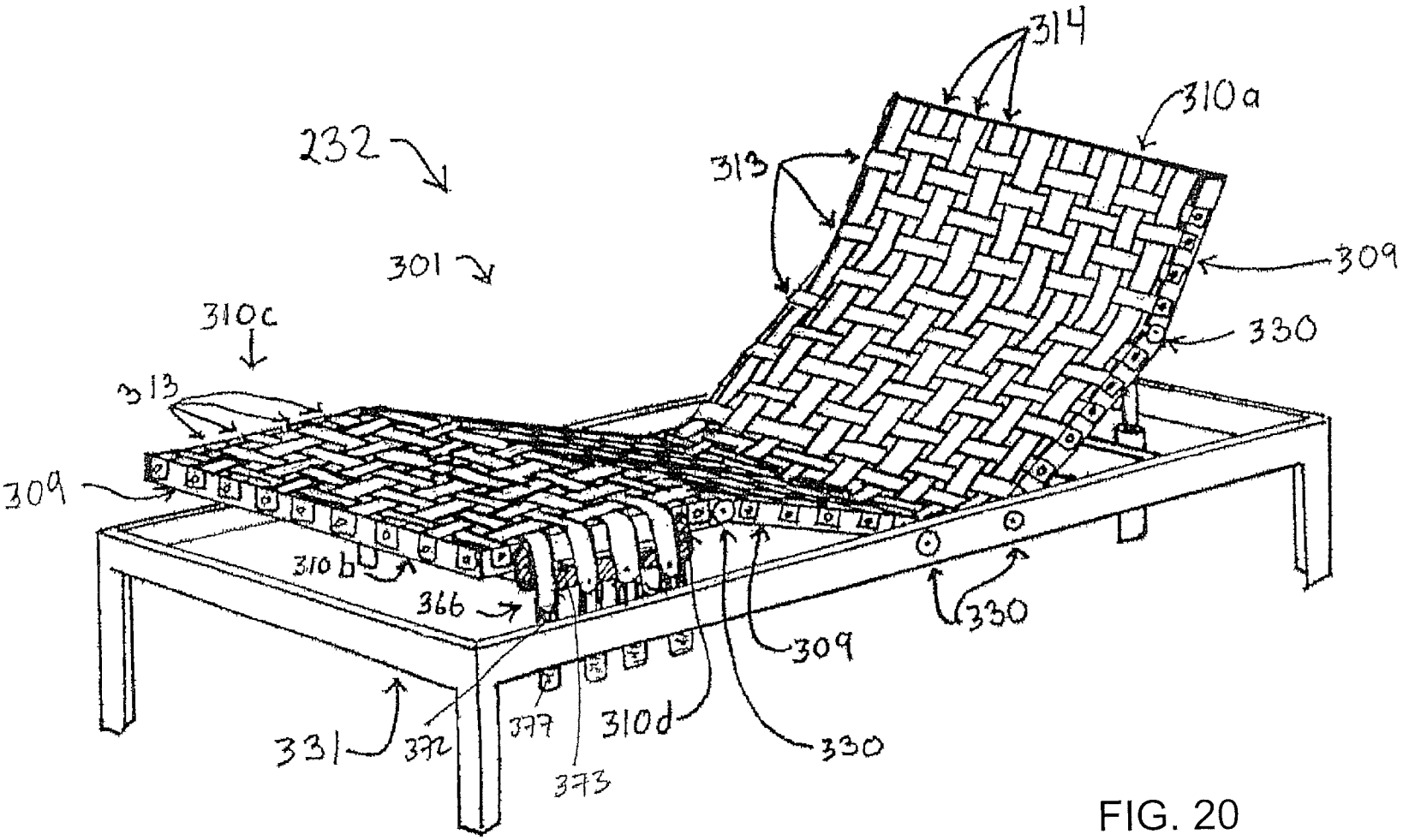
FIG. 20 is a perspective view of an exemplary embodiment of an adjustment apparatus for an adjustable articulated bed with interwoven support elements.

In an exemplary embodiment shown in FIG. 19, bed 301 uses an adjustment mechanism 366. In one embodiment adjustment mechanism 366 may be used with an articulated bed 232 as shown in FIG. 20. Articulated bed 232 can have a stationary frame 331, a perimeter frame 309 and one or more hinges 330. Hinges 330 are located such that frame members 310*c* and 310*d* have moveable sections. The moveable sections of frame members 310*c* and 310*d* allow articulated bed 232 to support a user in a greater number of anatomical positions. Articulated beds 232 commonly allow users to be supported in anatomical positions from reclined to fully supine. Many articulated beds are configured such that a user's knees may be elevated in unison with the user's head. A support surface with interwoven support elements is ideally suited to an articulated bed 232. The flexibility of interwoven support elements 313, 314 allows the moveable sections of frame members 310*c* and 310*d* to move without undue restraint.

In one embodiment, a bed 300, 232 uses one or more adjustment mechanisms 366, 380. In FIGS. 19 and 20, some transverse interwoven support elements 313 are shown using adjustment mechanisms 366. Adjustments mechanisms 366 may comprise a plurality of individual extensions 377 having tensioned adjustment mechanisms 172 thereon, or the extensions 377 may be attached to a chassis 373. As shown in FIG. 20, chassis 373 is attached to perimeter frame 309. Four transverse interwoven support elements 313 are connected to adjustment mechanism 366. In another embodiment, all or a majority of interwoven support elements 313, 314 may be connected to adjustment mechanisms 366, 380. Adjustment mechanisms 366, 380 should not impede motion of the moveable sections of perimeter frame 309. Adjustment mechanisms 366, 380 can use the tension devices 167, 172, 176, 179, or 186 described above or actuators 201, 202 described below. Actuators 201, 202 can also be used on adjustment mechanisms 166, 266, 180, 280.

Figure 21:
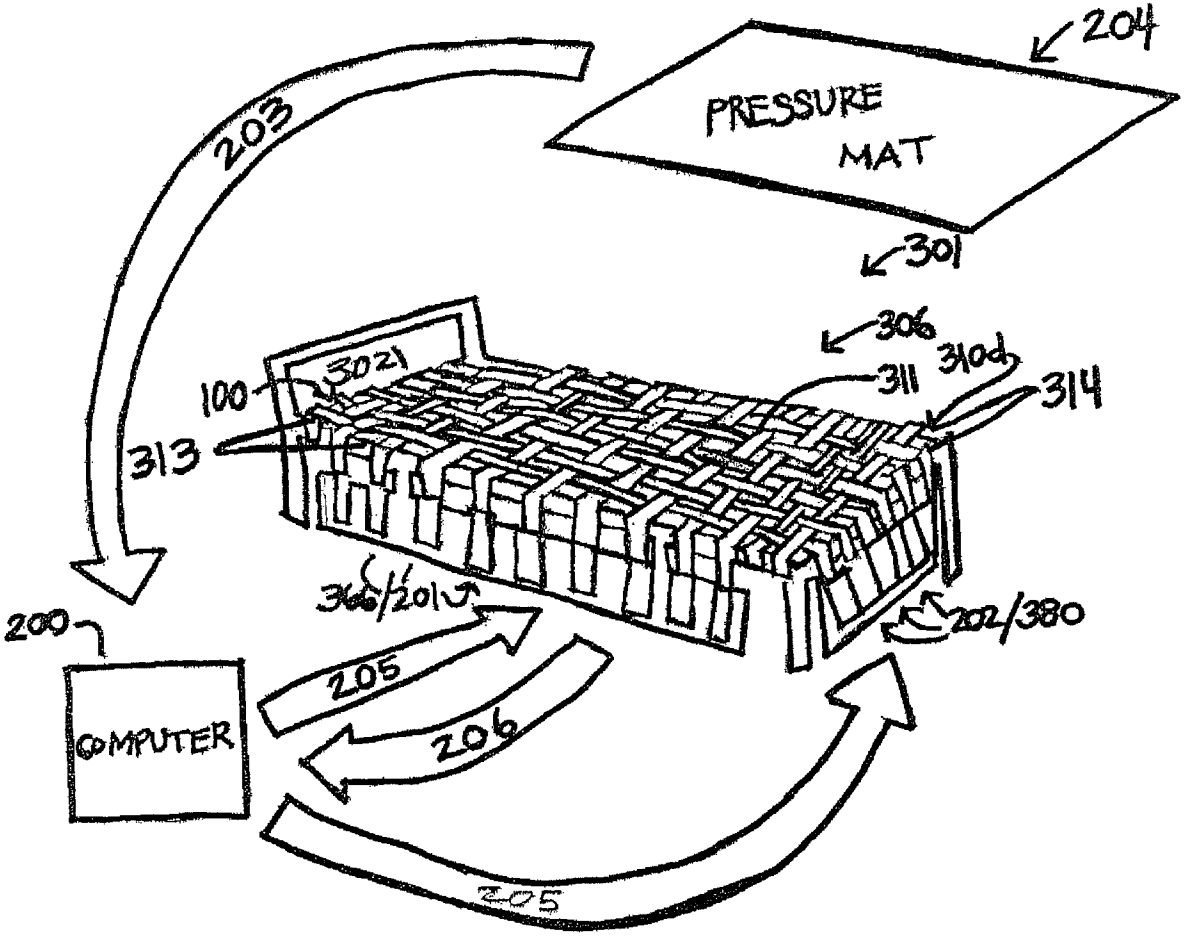
FIG. 21 is a perspective view of an exemplary embodiment of an adjustment apparatus for an adjustable bed with interwoven support elements.

In an exemplary embodiment, shown in FIG. 21, each of the adjustment mechanisms 166, 180, 266, 280, 366, 380 comprises actuators 201, 202 and a feedback system. In an exemplary embodiment, actuators 201, 202 are electric servos with a ball screw. Other types of suitable actuators 201, 202 include electric motors or fluid power devices for example. The feedback system comprises a pressure sensing device such as a pressure mat 204. Pressure mat 204 is a device commonly used in the wheelchair and bed fields to sense pressure on a support surface. In one embodiment, a computer 200 controls a series of actuators 201, 202, which are connected to interwoven support elements 313, 314, thereby commanding a change in the active length of the connected interwoven support elements. Computer 200 receives one or more input signal 203 from pressure mat 204 during the course of an adjustment. In an exemplary embodiment, electric servo actuators 201, 202 send a position signal to computer 200. Computer 200 sends one or more output signals 205 to actuators 201, 202 during the course of an adjustment to command the actuators 201, 202 to adjust the length of interwoven support elements 313, 314 in areas where the sensed pressure is not ideal. Actuators 201, 202 can adjust interwoven support elements 313, 314 with a user positioned upon mattress 301. While the apparatuses and methods have been described with reference to a mattress 301, they are also applicable to other support surfaces, such as seat cushion 100. Through a series of iterations of taking pressure readings and adjusting interwoven support elements 113, 114, 313, 314, the support surface 100, 301 can be optimized.

In one embodiment, an iterative method may be used to achieve a more ideal support surface contour. In the first step, a computer 200 receives an input signal 203 from a pressure mat 204. Typically a pressure mat 204 is placed between a mattress 300 and a user 308. Input signal 203 is related to pressure. Computer 200 compares pressure input signal 203 to a table of values to determine if pressure is acceptable. If pressure is not acceptable, computer 200 sends an output signal 205 to one or more actuators 201, 202. In response to output signal 205 actuators 201, 202 make adjustments to interwoven support elements 313, 314. Generally, interwoven support elements 313, 314 intersecting areas of excessive pressure load are lengthened or loosened. Interwoven support elements 313, 314 intersecting areas of excessively low pressure might be shortened or tightened. After actuators 201, 202 make adjustments of interwoven support elements 313, 314, computer 200 returns to the first step. Similarly, a fitter may manually adjust interwoven support elements 313, 314 based, in whole or in part, upon pressure information from pressure mat 204. The frequency of adjustments of mattress 301 depends on many factors such as a patient's mobility and personal preferences.

In one embodiment, mattress 301 can be adjusted when user 308 changes position or orientation. A feedback sensor can be used to determine when a user 308 changes position or orientation. This feedback sensor sends an input signal to computer 200. This input signal can come from many different sources. One or more magnets attached to user 308 interact with magnetic field sensors to determine user's 308 position or orientation. One or more cameras, lasers, force or pressure sensors can be used to determine user's 308 position or orientation. A user 308 or caregiver can operate a switch to send a signal to computer 200 when position or orientation is changed. When computer 200 receives an input signal that user 308 has changed position or orientation, an adjustment of mattress 301 may be performed.

In another embodiment, one or more previously determined mattress 300 support surface contours may be retrievable by computer 200. These contours may be related to anatomical positioning of user 308. When user 308 changes anatomical position, a related input signal is sent to computer 200. In response to this input, signal computer 200 retrieves a previously determined support surface contour. Computer 200 sends an output signal 205 to actuators 201, 202. Actuators 201, 202 adjust interwoven support elements 313, 314 to create a surface contour similar to the previously determined contour retrieved by computer 200. In one embodiment, a user 308 laying prone may roll over to the supine position. An input signal could be sent to computer 200 indicating that user 308 is laying supine. Computer 200 may then retrieve a support surface previously determined to be useful for supine users 308. Computer 200 sends output signal 205 to actuators 201, 202. Actuators 201, 202 adjust interwoven support elements 313, 314 to create a surface contour similar to one previously determined to be useful for supine users.

Feedback can be generated from many different types of sensors. Input signals commonly are related to patient position, size, shape or mass. A user position or orientation sensor is not always required to achieve an ideally contoured weight bearing surface. Computer 200 might use one or more input signals from a pressure mat, patient or caregiver input, position sensors, video cameras, lasers, force sensors or pressure sensors. Computer 200 may also receive an input signal 206 from actuators 201, 202. Input signal 206 from actuators 201, 202 contains information related to interwoven support elements 313, 314 such as length, position or tension. Other types of useful feedback sensors will be appreciated by those skilled in the art.

In the case where adjustments of interwoven support elements are performed automatically and a computer is used, the fitter or caregiver could be located remote to the actual device. Adjustments might be performed remotely by a caregiver or fitter using a computer remotely such as through the internet or via other means of communication.

Occasional to frequent mattress 301 adjustments may be desirable to protect a user from skin damage. In an embodiment, computer 200 controls adjustment of mattress 300 via one or more actuators 201, 202. Mattress 301 is adjusted by lengthening some interwoven support elements 113, 114 in a desired area and tightening other interwoven support elements. Interwoven support elements 313, 314 in a desired area are lengthened such that a low pressure load is created on a portion of a user's body. The portion of a user's body subject to low pressure load can be changed, through a series of support surface adjustments, such that over time all portions of the user's body are subjected to low pressure loads for some period. A series of adjustments to mattress 301 can assure that no area of a user's body is subjected to excessive pressure loads for a period of time likely to lead to skin damage. The above adjustment process can be repeated throughout the day.

Automatic adjustment of a mattress 301 using actuators 201, 202 is especially useful in the case of an articulated bed. Similar to the embodiments set forth herein, the interwoven support elements 313, 314 of an articulated bed can be adjusted using one or more actuators. In one embodiment, the actuators 201, 202 are pneumatic servos with a linearly variable differential transformer type feedback device capable of changing interwoven support element 313, 314 active length where the each interwoven support element 313, 314 tension is less than about 300 pounds. The load capacity of the actuators should generally be greater than the maximum interwoven support element tension during adjustment. Additional capacity may be needed for safety or other reasons. In the case of an articulated bed, the actuators are typically attached to perimeter frame 309 in such a way as to not impede motion of the moveable sections of frame members 310*c* and 310*d*.

Using the disclosed adjustment mechanisms, a support surface with interwoven support elements can be easily, accurately and quickly fit to a user without requiring that a fitter have specialized expertise. This offers numerous advantages over prior custom fabrication and fitting techniques that require making an impression, making a cast from an impression, and molding a seat cushion using the cast. Even after this, an expensive custom-made prior art seat cushion may still need modifications to meet the needs of the user for a good fit, comfort and safety. The disclosed adjustment mechanisms can adjust the user's actual wheelchair seat cushion or determine ideal support surface contours useful in making another type support surface.

The disclosed adjustment mechanisms allow a weight bearing surface of a mattress 301 or seat cushion 101 to be custom shaped to the particular contours of many different users 108, 308 with unique anatomy. For example, the mattress or seat cushion can effectively be used to create depressions, firm surfaces, and so forth. This can be critical in creating a weight-bearing surface that can conform to the shape of the body and can offload pressure and shear from tissue near boney prominences.

The substantially rigid perimeter frame to which the interwoven support elements can attach, the substantially inelastic interwoven support elements, and the interwoven support element fixtures that firmly hold the interwoven support elements can all contribute to a stable and consistent weight-bearing surface. This can ensure that the shape of the weight-bearing surface can persist. Many support surfaces such as those that have fluid or air-filled compartments lose pressure due to leakage or changes in atmospheric pressure. The disclosed support surface, on the other hand, can offer a very stable weight-bearing surface over the long term.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa. For example, all descriptions referring to a seat cushion are also applicable to a bed, and all descriptions referring to a bed are also applicable to a seat cushion. Moreover, while the embodiments have been described primarily with reference to a wheelchair seat cushion or a bed mattress, the teachings herein are also applicable to other support surfaces, including but not limited to pilot seats, office chairs, sports seats, and boat seats, for example.

What is claimed is:

1. An apparatus for adjusting an active length of a plurality of interwoven support elements of a weight bearing surface to conform to contours of a user's anatomy, the weight bearing surface overlying a frame to which the plurality of interwoven support elements are connected, the apparatus comprising:

an adjustment mechanism connected to one of the plurality of interwoven support elements, wherein the adjustment mechanism is attached to a chassis and the chassis is releasably attached to the frame, so that the adjustment mechanism is releasably attached to the frame via the chassis and wherein the adjustment mechanism is a tensioner comprising a spring or a friction mechanism;

wherein the adjustment mechanism allows the active length of the connected interwoven support element to change as a user bears upon the weight bearing surface, thereby conforming the weight bearing surface to the contours of the user's anatomy and wherein releasing the chassis and disconnecting the adjustment mechanism from the interwoven support element allows the weight bearing surface to retain an adjusted configuration such that the weight bearing surface can be custom shaped to the particular contour of a specific user.

2. The apparatus of claim 1 wherein the tensioner controls an amount of force required to change the active length of the connected interwoven support element.

3. The apparatus of claim 2 wherein the tensioner is adjustable such that the amount of force required to change the active length of the connected interwoven support element may vary.

4. The apparatus of claim 1 wherein the weight bearing surface comprises a plurality of transverse interwoven support elements and a plurality of longitudinal interwoven support elements, and wherein a first plurality of adjustment mechanisms is connected to at least some of the plurality of transverse interwoven support elements and wherein the apparatus further comprises a second plurality of adjustment mechanisms connected to at least some of the plurality of longitudinal interwoven support elements.

5. The apparatus of claim 1 wherein the active length of the connected interwoven support element increases as a user bears upon the weight bearing surface, and wherein the adjustment mechanism comprises a one-way mechanism or a lock, wherein the one-way mechanism or lock maintains the increased active length.

6. The apparatus of claim 1, and further comprising a plurality of adjustment mechanisms attached to the chassis, so that the plurality of adjustment mechanisms are releasably attached to the frame via the chassis.

7. The apparatus of claim 1 further comprising an encoder corresponding to the connected interwoven support element, wherein the encoder provides information related to the active length of the connected interwoven support element.

8. The apparatus of claim 1 further comprising a visible length scale corresponding to the connected interwoven support element, wherein the scale provides information related to the active length of the connected interwoven support element.

9. The apparatus of claim 1 further comprising a scanner that provides information related to a contour of the weight bearing surface.

10. The apparatus of claim 1 wherein the adjustment mechanism produces an audible signal related to a change in the active of length of the connected interwoven support element.

11. The apparatus of claim 1 wherein the adjustment mechanism further comprises a rotating drum attached to an end of the connected interwoven support element.

12. The apparatus of claim 11 wherein the rotating drum further comprises a wrap spring that controls rotation of the rotating drum.

13. The apparatus of claim 1 further comprising a vibrator.

14. The apparatus of claim 1 further comprising:

a computer, wherein the adjustment mechanism is an actuator, and wherein the computer is configured to control the actuator to thereby command a change in the active length of the connected interwoven support element.

15. A method for adjusting an active length of at least some of a plurality of interwoven support elements of a weight bearing surface overlying a frame to conform to contours of a user's anatomy, the method comprising:

providing an adjustment mechanism connected to a chassis;

connecting the chassis to the frame;

connecting the adjustment mechanism to one of the plurality of interwoven support elements wherein the adjustment mechanism is a tensioner comprising a spring or a friction mechanism;

positioning a user upon said weight bearing surface;

allowing the adjustment mechanism to change the active length of the connected interwoven support element in response to weight of the user bearing upon the weight bearing surface;

removing the user from the weight bearing surface after the active length of at least one of the plurality of interwoven support elements has been changed in response to weight of the user bearing upon the weight bearing surface;

releasing the adjustment mechanism from the connected interwoven support;

releasing the chassis from the frame;

retaining each of the interwoven support elements in its adjusted configuration such that the support surface can be custom shaped to the particular contour of a specific user.

16. The method of claim 15 comprising further changing the active length of the connected interwoven support element after the adjustment mechanism has changed the active length of the connected interwoven support element in response to weight of the user bearing upon the weight bearing surface.

17. The method of claim 15 further comprising:

positioning a pressure sensor between the user and the weight bearing surface, receiving information from the pressure sensor, and adjusting the active length of the connected interwoven support element in response to the information received from the pressure sensor.

18. The method of claim 15 wherein the tensioner controls an amount of force required to change the active length of the connected interwoven support element, the method further comprising adjusting the amount of force required.

19. The method of claim 15 further comprising obtaining a plurality of measurements related to a contour of the weight bearing surface.

20. The method of claim 15 further comprising:

positioning a casting element upon the weight bearing surface;

positioning the user upon the casting element; and allowing the casting element to cure, thereby providing a cast impression of the weight bearing surface under a weight bearing condition.

21. The method of claim 15 further comprising a fitter checking an underside of the weight bearing surface.

22. A method for adjusting an active length of at least some of a plurality of interwoven support elements of a weight bearing surface to conform to contours of a user's anatomy, the method comprising:

providing an adjustment mechanism connected to one of the plurality of interwoven support elements;

positioning a user upon said weight bearing surface;

allowing the adjustment mechanism to change the active length of the connected interwoven support element in response to weight of the user bearing upon the weight bearing surface;

removing the user from the weight bearing surface after the active length of at least some of the plurality of interwoven support elements has been changed in response to weight of the user bearing upon the weight bearing surface; and retaining each of the interwoven support elements in its adjusted configuration such that the support surface can be custom shaped to the particular contour of a specific user.

* * * * *